US009370784B2

(12) United States Patent
Katou et al.

(10) Patent No.: US 9,370,784 B2
(45) Date of Patent: Jun. 21, 2016

(54) BUBBLE GENERATING MECHANISM AND SHOWERHEAD WITH BUBBLE GENERATING MECHANISM

(75) Inventors: Hiroo Katou, Kitanagoya (JP); Yoshiki Shibata, Kitanagoya (JP)

(73) Assignee: Shibata Corporation, Kitanagoya-shi, Aichi (JP)

( * ) Notice: Subject to any disclaimer, the term of this patent is extended or adjusted under 35 U.S.C. 154(b) by 108 days.

(21) Appl. No.: 14/234,032

(22) PCT Filed: Jul. 20, 2012

(86) PCT No.: PCT/JP2012/068480

§ 371 (c)(1),
(2), (4) Date: Jan. 21, 2014

(87) PCT Pub. No.: WO2013/012069

PCT Pub. Date: Jan. 24, 2013

(65) Prior Publication Data

US 2014/0151470 A1 Jun. 5, 2014

(30) Foreign Application Priority Data

Jul. 21, 2011 (JP) ..... 2011-160272

(51) Int. Cl.

| | |
|---|---|
| ***B05B 1/18*** | (2006.01) |
| ***B01F 3/04*** | (2006.01) |
| ***B01F 5/06*** | (2006.01) |

(52) U.S. Cl.

CPC ..... *B05B 1/185* (2013.01); *B01F 3/04503* (2013.01); *B01F 5/068* (2013.01); *B01F 5/0663* (2013.01); *B01F 5/0671* (2013.01); *B05B 1/18* (2013.01); *B01F 2003/04858* (2013.01)

(58) Field of Classification Search

CPC .. B01F 3/04503; B01F 3/0451; B01F 5/0663; B01F 5/0671; B01F 5/068; B01F 2003/04858; B05B 1/18; B05B 1/185

USPC ..... 261/75, 108, 110, 111, 115; 239/589

See application file for complete search history.

(56) References Cited

U.S. PATENT DOCUMENTS 5,427,181 A 6/1995 Laskaris et al.
5,575,561 A * 11/1996 Rohwer ..... 366/336

(Continued)

FOREIGN PATENT DOCUMENTS

JP 2006-116518 A 5/2006
JP 2007-50341 A 3/2007

(Continued)

OTHER PUBLICATIONS

International Search Report (translation) PCT/JP2012/068480, Oct. 2012.

(Continued)

*Primary Examiner* — Charles Bushey
(74) *Attorney, Agent, or Firm* — Quarles & Brady LLP; Gavin J. Milczarek-Desai

(57) ABSTRACT

Provided is a bubble generating mechanism that does not use a complicated air mixing mechanism and generates micro-bubbles in a sufficient quantity. A flow path (2) that connects an inflow opening (2*n*) that opens on an inflow end and an outflow opening (2*x*) that opens on an outflow end is formed in a state passing completely through a member main body (6), and a constricted part (2*c*) the flow-through cross-sectional area of which is smaller than the inflow opening (2*n*) is formed in a position within that flow path (2). Colliding parts (3) that further reduce the cross-sectional area of the flow path in the constricted part (2*c*) are disposed in the constricted part (2*c*) in a state that divides the axial plane of the flow path (2) into three or more segment areas (2*e*).

1 Claim, 24 Drawing Sheets

(56) References Cited

U.S. PATENT DOCUMENTS

| | | | | |
|---|---|---|---|---|
| 6,193,171 | B1 * | 2/2001 | Albertson | 239/381 |
| 6,732,957 | B2 * | 5/2004 | Kanaya et al. | 239/443 |
| 2013/0214436 | A1 * | 8/2013 | Mori | 261/19 |

FOREIGN PATENT DOCUMENTS

| | | | |
|---|---|---|---|
| JP | 2007-209509 | A | 8/2007 |
| JP | 2008-73432 | A | 4/2008 |
| JP | 2008-229516 | A | 10/2008 |
| JP | 2008-290051 | A | 12/2008 |
| JP | 2008-307511 | A | 12/2008 |
| JP | 2008018330 | A | 5/2010 |
| WO | WO2010055702 | A1 | 5/2010 |

OTHER PUBLICATIONS

Written Opinion (translation) PCT/JP2012/068480, Oct. 2012.
Takahashi et al., National Institute of Advanced Industrial Science and Technology (AIST), Internet homepage http://unit.aist.go.jp/emtech-ri/26env-fluid/pdf/takahashi.pdf, "Research on Microbubbles and Nanobubbles".
European 12814186 Search Report dated Jun. 23, 2015.

* cited by examiner

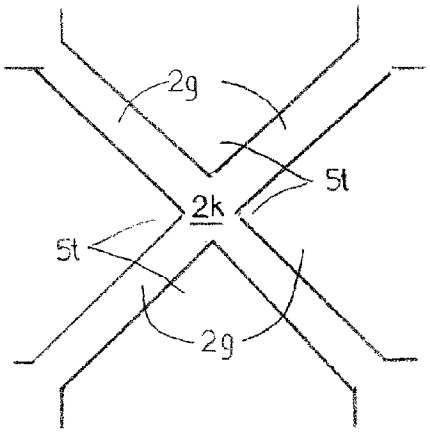
FIG. 3
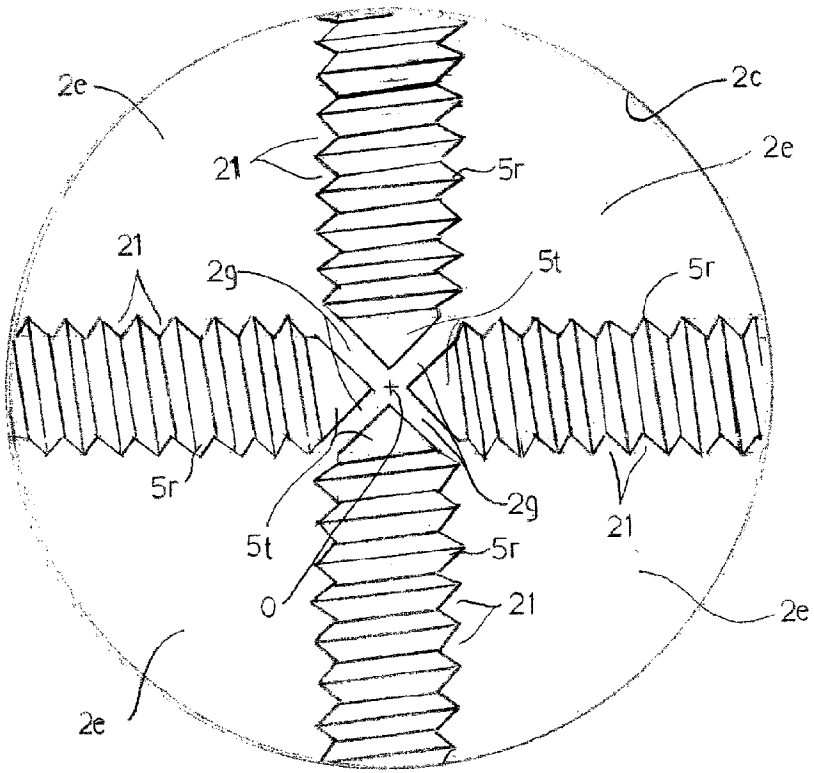

BUBBLE GENERATING MECHANISM AND SHOWERHEAD WITH BUBBLE GENERATING MECHANISM

TECHNICAL FIELD

The present invention relates to a bubble generating mechanism, in particular to a mechanism suitable for generating fine bubbles such as micro bubbles and nano bubbles, and to a showerhead using the mechanism.

BACKGROUND ART

Bubbles formed in water are classified into milli bubbles or micro bubbles (or even, micro-nano bubbles, nano bubbles and the like) depending on their size. The milli bubbles are relatively large bubbles. The milli bubbles rise up in the water rapidly, break on the water surface and finally disappear. In contrast, bubbles having diameters equal to or less than 50 μm have following special properties. The above bubbles are very small and therefore stay longer in the water. Also, the bubbles have excellent gas solubility in the water. As a result, the bubbles further reduce in size in the water and finally disappear (i.e., dissolve completely) in the water. Such bubbles have generally come to be known as micro bubbles (refer to Non-Patent Document 1). In the present specification, the term "fine bubbles" generally indicates the above micro bubbles and also indicates bubbles having smaller diameters such as micro-nano bubbles (bubbles having diameters equal to or greater than 10 nm and less than 1 μm) and nano bubbles (having diameters less than 10 nm).

Recently, such fine bubbles are used in many applications, and there have been suggested various showers specifically used in bath rooms or the like with built-in bubble generating mechanisms (refer to Patent Documents 1 to 5). The bubble generating mechanisms assembled in the showers disclosed in Patent Documents are classified into two types of a mechanism of Patent Document 1 and another mechanism of Patent Documents 2 to 5. In the mechanism of Patent Document 1 (also referred to as a two-phase-flow swirl-type mechanism), swirling flow generating blades are assembled into a head part that sprays a shower water flow. A vortex flow formed by the blades is mixed with external air suctioned by vacuum through a narrow hole formed in a blade shaft portion, thereby mixing the gas and the liquid. In the other mechanism (a cavitation type mechanism) of Patent Documents 2 to 5, a restriction mechanism such as a Venturi tube is assembled into a shower main body (a handle part extending from a head part). When water passes through the restriction mechanism at an increased flow rate, a pressure reduction effect generated based on Bernoulli's principle causes the air dissolved in the water to deposit as fine bubbles.

PRIOR ART REFERENCE

Patent Document

Patent Document 1: JP-A-2008-229516

Patent Document 2: JP-A-2008-73432

Patent Document 3: JP-A-2007-209509

Patent Document 4: JP-A-2007-50341

Patent Document 5: JP-A-2006-116518

Non-Patent Document 1: Webpage (http://unit.aist.go.jp/emtech-ri/26env-fluid/takahashi.pdf)

SUMMARY OF THE INVENTION

Problems to be Solved by the Invention

However, none of the above conventional showers achieves a sufficient level in terms of the size of the fine bubbles, nor achieves a sufficient quantity level in terms of generation of the micro bubbles having longer retention time in the water, specifically bubbles in the range of micro-nano bubbles having particle diameters less than 1 μm, disadvantageously. Also, the two-phase-flow swirl-type mechanism represented by Patent Document 1 needs to have the swirling flow generating blades assembled in the showerhead, thereby complicating the mechanism disadvantageously. Furthermore, the mechanism is not capable of providing rotational speed sufficient for changing the suctioned external air into sufficiently small bubbles using service water pressure for a general use such as bathing. This leads to poor efficiency in generating the fine bubbles in a range equal to or smaller than the micro bubbles disadvantageously.

The cavitation type shower in Patent Documents 2 to 4 is configured to have only one restriction hole with a closed periphery such as a Venturi tube or an orifice. This means that there is no flow channel part other than the restriction hole around the restriction hole. As a result, when a fluid passes through the restriction hole, fluid resistance increases and thereby the flow rate will not increase to expected levels. Also, the restriction hole is subject to back pressure from an internal wall surface of the hole in a radial direction. Consequently, a cavitation effect (pressure reduction effect) becomes insufficient, and thereby the amount of deposited bubbles is likely to be insufficient disadvantageously.

It is an objective of the present invention to provide a bubble generating mechanism that is capable of generating a sufficient amount of bubbles without using a complicated gas-liquid mixture mechanism and capable of increasing generation amount of bubbles in the range of micro bubbles or micro-nano bubbles to a level that has not been achieved conventionally and to provide a showerhead using the bubble generating mechanism.

Means for Solving the Problems

In order to solve the above problems, a bubble generating mechanism according to an aspect of the present invention has:

a component main body having an inflow end on a liquid inflow side and an outflow end on a liquid outflow side;

a flow channel formed in the component main body to extend therethrough, the flow channel connecting an inflow port opening in the inflow end with an outflow port opening in the outflow end;

a restrictor formed at a point within the flow channel, the restrictor having a passage cross-sectional area smaller than that of the inflow port; and collision parts provided at the restrictor to divide a transverse cross-section of the flow channel into three or more segment regions such that the collision parts further reduce the passage cross-sectional area of the restrictor, wherein:

after a flow of gas-dissolved liquid supplied to the inflow end of the component main body collides with the collision parts, the flow is distributed to each of the segment regions and then passes through the segment regions at an increased flow rate;

the gas-dissolved liquid is changed into bubble-containing liquid by depositing dissolved gas using a resulting pressure reduction effect; and the bubble-containing liquid flows out of the outflow port.

When a water flow is supplied to the bubble generating mechanism, liquid supplied to the flow channel is restricted by the restrictor and the flow rate thereof is increased. As a result, a vacuum area is formed at the restrictor (and a downstream area thereof) based on Bernoulli's principle, and gases (for example, air) dissolved in the water flow deposit due to the cavitation effect (pressure reduction effect) to generate bubbles.

The bubbles in the water are likely to merge when colliding with each other differently from solid particles. For example, if the water flow is simply made to pass through the known restriction mechanism such as a Venturi tube, the resulting flow rate is insufficient. Thus, the pressure reduction level at a position downstream of the restriction hole is small, and thereby the generating amount of the vortex flow is small. Also, in the above restriction mechanism, the restrictor is configured to reduce a cross-section of the flow channel in a homothetic manner. Therefore, if the cross-section of the restrictor is reduced excessively in order to increase the flow rate, resistance of passage of the fluid is increased. Thereby, an increase in the flow rate is not achieved proportionally to a reduction ratio of the cross-section. As a result, the bubble generating efficiency is lowered disadvantageously. Thus, the amount of bubbles formed by deposition due to the cavitation is small, and it is impossible to sufficiently cause collision between bubbles to break the bubbles. Consequently, it is impossible to sufficiently generate fine bubbles.

In contrast, in the bubble generating mechanism of the present invention, the collision parts are provided at the restrictor to divide the transverse cross-section of the flow channel into three or more segment regions such that the collision parts further reduce the passage cross-sectional area of the restrictor. In other words, the cross-sectional area of the flow channel is not reduced in a radial direction in a homothetic manner toward the cross-sectional center, where the flow rate is high. Rather, by using the collision parts as an obstacle, the cross-section of the flow channel is reduced by partly removing a region, where the liquid could pass through, along a circumferential direction around the cross-sectional center. As a result, the fluid resistance at the restrictor is not increased excessively, and the effect of increasing the flow rate and the effect of generating negative pressure are greatly enhanced. Due to the above, the cavitation effect (pressure reduction effect) at each segment region (and the region downstream thereof) is enhanced greatly, and thereby, even with a water flow with the same dissolved air concentration, a larger amount of bubbles can deposit.

In the bubble generating mechanism of the present invention, fluid that flows into the segment regions mainly bypasses the tip end portions of the collision parts to flow into the regions, and the flow rate of the flow near the cross-sectional center where the flow rate is maximized is reduced due to the detour. In the above case, it is effective to provide a high-speed flow gap formed between tip end portions of two or more of the collision parts projecting toward a cross-sectional center of the restrictor for allowing a cross-sectional central flow to pass therethrough at a flow rate higher than that of a cross-sectional peripheral flow. Due to the above, the flow near the cross-sectional center can pass through the high-speed flow gap without substantially being decelerated. Thus, the high-speed flow can be used to generate fine bubbles quite effectively.

The high-speed flow gap may be formed in various shapes. For example, the tip end portion of each of the collision parts may have a conical portion having a transverse cross-section reduced toward a tip end thereof. A slit part constituting the high-speed flow gap may be formed between outer peripheral surfaces of the two conical portions of the collision parts adjacent to each other across the segment region. The slit part is formed along a direction of the generatrix of the outer peripheral surface of the conical portion. Therefore, the flow toward the slit part is restricted and compressed when the flow detours the swelling along the generatrix of the conical portion. At that time, a space for the compressed liquid to flow is secured in a longitudinal direction of the slit part. Therefore, the flow rate is not likely to be reduced, and the cavitation effect (pressure reduction effect) is further enhanced. In a conventional Venturi tube or orifice, the cavitation generating region has been formed as a point near a restriction center. In contrast, the cavitation generating region in the above configuration is linearly formed along the slit part. Therefore, a region where the bubbles deposit due to the pressure reduction is significantly enlarged, and thereby a large amount of fine bubbles can be formed.

Alternatively, at least a pair of the collision parts may be arranged to be opposed to each other in a direction of an internal diameter across a cross-sectional center of the restrictor, and a central gap may be formed between tip ends of the pair of collision parts to constitute the high-speed flow gap. Due to the above configuration, the flow at the cross-sectional center where the flow rate is maximized can pass through the central gap without substantial loss. The flow at the cross-sectional center is accelerated since the flow is further restricted when passing through the central gap. However, the flow is allowed to detour toward the segment regions, effectively limiting an increase in the fluid resistance. Thus, the cavitation effect (pressure reduction effect) is greatly enhanced and the flow rate at the cross-sectional center is greatly increased. Therefore, a larger amount of fine bubbles can deposit.

The collision parts may be formed in the shape of a cross such that projecting directions of the collision parts orthogonally intersect with each other on a transverse section of the restrictor. The restrictor is divided by the collision parts into four restriction segment regions. The collision parts are positioned to be orthogonal to each other to divide the restrictor into the four restriction segment regions. Thus, symmetricity of the collision parts and resulting restriction segment regions relative to the cross-sectional center is improved, and thereby the fine bubbles can deposit uniformly in each of the restriction segment regions.

In the above case, a high-speed flow gap can be formed between tip end portions of two or more of the collision parts projecting toward a cross-sectional center of the restrictor, the high-speed flow gap allowing a cross-sectional central flow to pass therethrough at a flow rate higher than that of a cross-sectional peripheral flow. Four collision parts can be provided to project from the inner peripheral surface of the flow channel toward the central part of the flow channel. Also, the tip end portion of each collision part may have a conical portion having a cross-section reduced toward the tip end to form slit parts, which constitute a high-speed flow gap between corresponding outer peripheral surfaces of the conical portions of the collision parts adjacent to each other across the segment region. As a result, the central gap constituting a part of the high-speed flow gap is formed between the tip ends of the collision parts located to be opposed to each other in a direction of an inner diameter across the cross-sectional center of the restrictor. The high-speed flow gap is formed in the shape of a cross with the four slit parts integrated via the central gap.

Due to the above configuration, the flow at the cross-sectional center where the flow rate is maximized is effectively restricted by four conical portions provided to surround the cross-sectional center and flows into the central gap at increased speed. The central gap is communicated with the surrounding four slit parts, and the flow restricted and compressed within the central gap turns to the slit parts. Consequently, an increase in the fluid resistance is suppressed effectively. Since the turned flow is restricted by the slits, a decrease in the flow rate after the detour is also limited to be small. As a result, the cavitation effect (pressure reduction effect) is very active not only at the central gap but also at the slit parts, and thereby it is possible to generate fine bubbles of nano-bubble levels at high concentrations.

In the above case, the tip end of the collision part that faces the central gap may be sharpened such that the flow passing by the tip end can be specifically accelerated. As a result, the size of the bubbles can be remarkably reduced. Alternatively, the tip end of the collision part may be flat. In this case, it is possible to enlarge the central gap and to uniform the flow, thereby contributing to the increase of the concentration of the generated fine bubbles as a whole.

The collision parts include a main collision part provided to intersect with the cross-section of the restrictor along an inner diameter and a pair of opposed collision parts opposed to each other along the inner diameter direction across the cross-sectional center of the restrictor to be orthogonal to the main collision part. A peripheral gap constituting the high-speed flow gap is formed between an end surface of each of the opposed collision parts and an outer peripheral surface of the main collision part. Specifically, when an inner diameter dimension of the restrictor needs to be shortened, the above construction can be made simpler than the configuration forming the central gap. The flow near the cross-sectional center collides with the main collision part and bypasses the main collision part. The flow is accelerated by a centrifugal force due to bypassing the main collision part and passes through the peripheral gap formed by the opposed collision parts. Thus, it is advantageous that the influence caused by the decrease in the flow rate due to the collision with the main collision part is not substantial.

In the above case, the tip end of the opposed collision part may be flat. This makes it possible to form the peripheral gap in the shape of a slit, and thereby the cavitation region can be expanded in a slit longitudinal direction. As a result, it is possible to generate fine bubbles of higher concentrations. The main collision part may include a pair of collision parts each having a flat end surface such that the collision parts are opposed to each other in the inner diameter direction of the restrictor and such that a central gap including a cross-sectional center of the restrictor is formed between the end surfaces of the collision parts. When the main collision part is divided as above and the central gap is formed between the end surfaces, the flow near the cross-sectional center, where the flow rate is maximized, is further restricted by the central gap and is accelerated. In addition, the flow compressed within the central gap detours toward the peripheral gap in the shape of slit, and thereby it is possible to effectively suppress an increase in the fluid resistance. Because the peripheral gap is also restricted into the slit-like shape, a decrease in the flow rate in the detour is limited to be small. As a result, the cavitation effect (pressure reduction effect) is activated significantly both in the central gap and the slit parts, and thereby it is possible to generate fine bubbles of nano-bubble levels at high concentrations.

Alternatively, the tip end of the opposed collision part may be sharpened. Thus, the restriction effect near the tip end of the opposed collision part at the peripheral gap is enhanced, and thereby it is possible to reduce the size of the bubbles due to the high flow rate. In the above case, the main collision part may include a pair of collision parts, each of which has a flat end surface with a chamfered part formed along an outer periphery of each end surface such that the pair of collision parts are opposed to each other in the inner diameter direction of the restrictor with the end surfaces thereof in contact with each other. In the above case, the peripheral gap may be formed such that the tip ends of the opposed collision parts face a groove formed by the chamfered parts of the two collision parts constituting the main collision part and having a V-shaped cross-section. Due to the above, the increase in the flow rate of the flow around the tip ends of the above opposed collision parts enhances the effect of further reducing the size of the bubbles.

An outer peripheral surface of the collision part may have circumferential restriction ribs turning thereon multiple times and arranged along a projecting direction of the collision part. In the above, gas-dissolved liquid flowing in a tangential direction of the outer peripheral surface of the collision part is restricted within grooves (or root portions) between the restriction ribs and is further accelerated. Thus, the pressure reduction effect is enhanced. On the other hand, the flow on a root opening side has a relatively reduced flow rate, and pressure on the root opening side becomes higher than the pressure of the high-speed flow on the root bottom side. As a result, a gas saturation solubility of the liquid on the root opening side increases, and the saturation solubility on the root bottom side decreases. Thus, the gas-dissolved liquid flows toward the root bottom side, and thereby it is possible to deposit the bubbles extremely actively.

If the root portion has a shape with a width reduced toward the bottom of the root, the shape is preferable for enhancing the flow restriction effect and the effect of depositing the bubbles within the root portion. In the above case, the multiple restriction ribs should be preferably formed such that crests thereof have an acute angle and are adjacent to each other. Apex angles of the restriction ribs should be preferably set in a range from 20 degrees to 60 degrees from a viewpoint of appropriating the above effect.

The restriction ribs turning multiple times may be formed integrally as a helix. Due to the above, the formation of the restriction ribs is facilitated, and because the restriction ribs are inclined relative to the flow, more flow components intersect with the edge lines of the restriction ribs. This significantly enhances a turbulent flow generation effect due to separation of the flow, and thereby the size of the bubbles can be further reduced advantageously. In this case, if the collision part is formed by a threaded member and an end of a leg part of the threaded member projects into the flow channel, thread ridges formed on the outer peripheral surface of the leg part of the threaded member can be used as the restriction ribs. Thus, the production of the collision part is facilitated.

If the restriction ribs are formed continuously on the outer peripheral surfaces of all the collision parts, the restriction ribs (and the root portions) form a number of cavitation points for depositing the bubbles on the collision parts contacting both sides of each of the segment regions. This significantly activates the bubble deposition and increases the bubble concentration in the water flow. If the bubble generating mechanism of the present invention is assembled to a showerhead or a water flow spray part of the bath tub, a large amount of bubbles can be introduced to an extent that a cloudy water flow can be formed only by using the deposition of the bubbles due to the cavitation even without taking in external air. Thus, rendition with a visual impact can be provided. However, when the flow rate of the flow flowing into the restrictor is high, there is a possibility that excessive deposition of the bubbles occurs, and thereby the deposited bubbles may merge with each other to reduce the concentration of the fine bubble accidently. Therefore, if the generation of fine bubbles is prioritized, it is effective to form the restriction ribs on only a part of the outer peripheral surfaces of all the collision parts in order to control the rate of the deposition of the bubbles at the root portions. In this case, it is effective not to form the restriction ribs on the tip end portions of the collision parts positioned at the cross-sectional center where the high flow rate largely contributes to generation of the fine bubbles but to form the restriction ribs on the other regions in order to prevent the loss of the fine bubbles due to the merge of the bubbles. Alternatively, some of the multiple collision parts may have the restriction ribs formed thereon and the rest of the collision parts may have no restriction ribs formed thereon.

In the bubble generating mechanism of the present invention, if the outer peripheral surface of the component main body has a cylindrical surface shape, the component main body can be received coaxially within a tubular member. In this case, a part of the tubular member upstream of the inflow end of the component main body serves as a liquid supply conduit. Another part of the tubular member downstream of the outflow end of the component main body serves as a liquid recovery conduit. Thus, the liquid supply conduit and the liquid recovery conduit can be provided simultaneously with the single tubular member, so the number of components can be reduced. In this case, a ring-like shaped sealing member should be preferably provided between the outer peripheral surface of the component main body and the inner peripheral surface of the tubular member to liquid-tightly seal a gap between the outer peripheral surface and the inner peripheral surface, thereby blocking the flow leaking toward the outer peripheral surface of the component main body. Also, if the component main body is formed as a circular-column-like member, whose both end surfaces on the inflow end side and the outflow end side are flat surfaces orthogonal to a longitudinal axis of the outer peripheral surface, such the shape is preferable because the component main body is easy to produce and to mount to the tubular member.

An inflow-side tapered part may be formed on the inflow port side of the flow channel such that the inflow-side tapered part has a diameter increased toward the inflow port. Due to the above, the flow rate can be further increased at the restrictor, thereby enhancing the bubble generating effect. Also, an outflow-side tapered part may be formed on the outflow port side of the flow channel with the collision parts such that the outflow-side tapered part has a diameter increased toward the outflow port. Due to the above, it is possible to decelerate the flow having passed through a flow channel cross-sectional area reducing part with a small loss and to deliver the flow to the outflow end side of the component main body. Thereby, it is possible to improve the efficiency in the flow of bubble-containing liquid out of the bubble generating mechanism. In the configuration, a constant cross-section part having a constant flow channel cross-sectional area may be provided as the restrictor between the inflow-side tapered part and the outflow-side tapered part of the flow channel with the collision parts, and the collision parts may be provided at the constant cross-section part. As a result, while the flow accelerated by the inflow-side tapered part is stabilized at the constant cross-section part, the flow can be guided to the collision parts and to the flow channel cross-sectional area reducing part. Thus, it is possible to generate bubbles more stably.

Lastly, the present invention provides also a showerhead using the bubble generating mechanism of the present invention.

Specifically, the showerhead has:

the bubble generating mechanism of the present invention;

a water flow supply part configured to supply a water flow to the inflow end of the component main body of the bubble generating mechanism; and a water flow spraying part configured to spray, as a shower water flow, the bubble-containing liquid collected at the outflow end of the component main body.

According to the showerhead of the present invention, the bubble generating mechanism of the present invention is assembled into the showerhead. Therefore, it is possible to easily form a shower water flow containing a larger amount of bubbles even from the water flow having the same concentration of the dissolved air. Also, because the dissolved air deposits into the bubbles due to a pressure reduction effect, concentration of dissolved oxygen in bulk water (or concentration of dissolved chlorine in service water) is reduced, and thereby it is possible to effectively reduce the influence of the oxygen (or the chlorine) on skin and hair contacting the shower water flow.

BRIEF DESCRIPTION OF THE DRAWINGS

FIG. 3 is an enlarged diagram illustrating a main part of the bubble generating engine of FIG. 2.

EMBODIMENT FOR CARRYING OUT THE INVENTION

Embodiments for carrying out the present invention will be described below with reference to the accompanying drawings.

Figure 1:
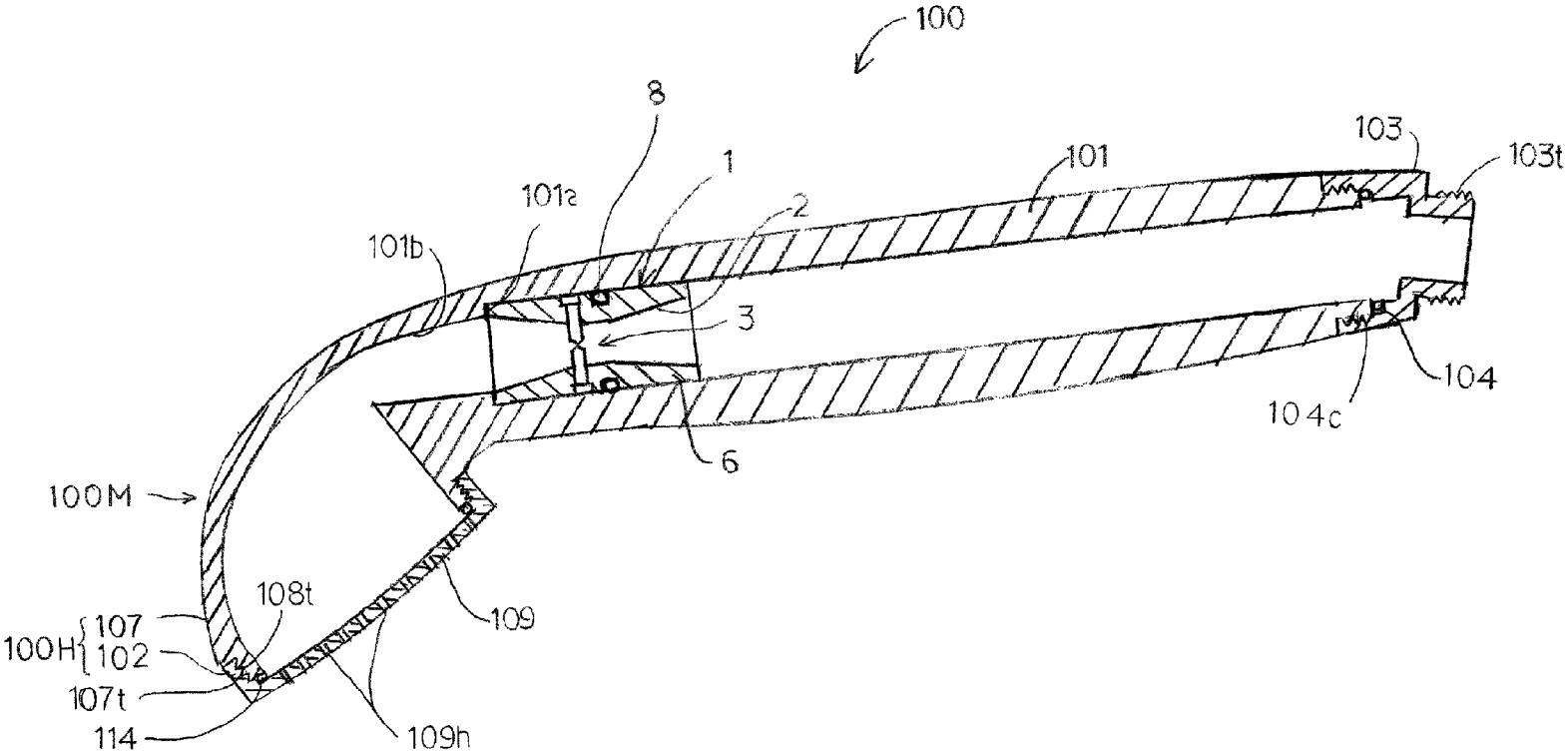
FIG. 1 is a side cross-sectional view and a front view illustrating an example of a shower with a bubble generating mechanism according to the present invention.

FIG. 1 shows an appearance and an internal structure cross-section of a shower 100 with a bubble generating mechanism (which will be also simply referred to as "shower" hereinafter) according to one embodiment of the present invention. The shower 100 includes a grip part 101, a shower main body 100M, and a bubble generating engine 1 (bubble generating mechanism). The shower main body 100M has a head part 100H integrated with the end thereof. The bubble generating engine 1 is assembled into the shower main body 100M. The shower main body 100M is made as a solid plastic mold.

In the present embodiment, the bubble generating engine 1 is received within the tubular grip part 101. Specifically, the bubble generating engine 1 in the shape of a circular column is coaxially inserted into the grip part 101 from a rear end side opening, and a front end face outer peripheral edge of the engine 1 is engaged with a step part 101*a* formed on an inner peripheral surface on a front end of the grip part 101. A component main body 6 is made of a resin (or may be made of a metal). The outer peripheral surface of the component main body 6 is formed in the shape of a cylindrical surface. The component main body 6 is coaxially received within the grip part 101 (tubular member). More specifically, the component main body 6 is formed as a circular-column-like member, whose both end surfaces on an inflow end side and an outflow end side are flat surfaces orthogonal to a longitudinal axis of the outer peripheral surface thereof. A part of the grip part 101 upstream of the inflow end of the component main body 6 serves as a liquid supply conduit, and another part of the grip part 101 downstream of the outflow end of the component main body 6 serves as a liquid recovery conduit (spray restrictor 101*b*). A ring-like sealing member 8 is provided between the outer peripheral surface of the component main body 6 and the inner peripheral surface of the grip part 101 (tubular member) for fluid-tightly sealing a gap between the outer peripheral surface and the inner peripheral surface, thereby suppressing leakage toward the outer peripheral surface of the component main body 6.

A thread portion 104*c* is formed on a rear end part of the grip part 101. A hose connection part 103 is connected to the thread portion 104*c* by thread connection through a sealing ring 104. The hose connection part 103 has a thread portion 103*t* formed thereon, to which a shower hose (not shown) is attached by thread connection. Water flow is supplied into the grip part 101 through the shower hose.

A tapered restrictor 101*b* is formed on the inner peripheral surface of the grip part 101 ahead of the front end surface of the bubble generating engine 1 fixed by the step part 101*a*. The water flow having passed through the bubble generating engine 1 is accelerated by the restrictor 101*b* and is supplied to the shower main body 100M integrally formed at a tip end side of the grip part 101 in communication with the grip part 101. Then, the water flow is sprayed as a shower water flow through a spraying plate 109, on which multiple water flow spraying openings 109*h* are formed dispersedly, of a water flow spraying part 102.

The head part 100H includes a back-side main body 107 and the water flow spraying part 102. The back-side main body 107 is formed integrally with the grip part 101. The water flow spraying part 102 is attached to a thread portion 107*t* formed on the peripheral edge of the opening of the back-side main body 107 by thread connection at a thread portion 108*t* via a sealing ring 114. The water flow passing through the bubble generating engine 1 flows into the head part 100H via the restrictor 101*b* and is sprayed through the spraying plate 109.

Figure 2:
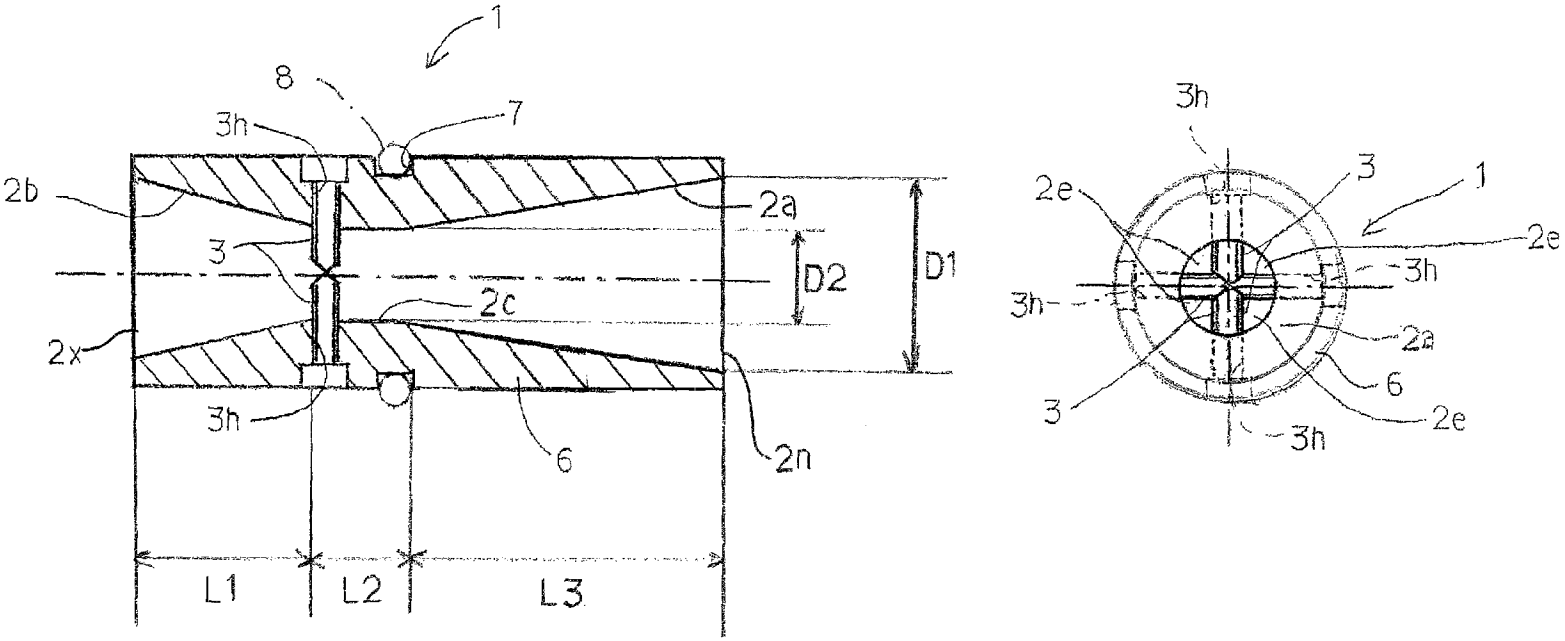
FIG. 2 is an explanatory diagram of a bubble generating engine assembled in the shower with the bubble generating mechanism of FIG. 1.

FIG. 2 is an enlarged view illustrating the bubble generating engine 1 taken out of the shower. The component main body 6 includes an inflow port 2*n*, an outflow port 2*x*, and a flow channel 2. The inflow port 2*n* opens at an inflow end of the component main body 6 and the outflow port 2*x* opens at an outflow end of the component main body 6. The flow channel 2 penetrates through the component main body 6 and connects the inflow port 2*n* with the outflow port 2*x*. The flow channel 2 has a restrictor 2*c* at a point thereof. The restrictor 2*c* has a passage cross-sectional area smaller than that of the inflow port 2*n*. As shown in FIG. 3, the restrictor 2*c* has collision parts 3 that divide the transverse cross-section of the flow channel 2 into three or more segment regions 2*e* (four segment regions 2*e* in the present embodiment). Thus, the collision parts 3 further reduce the passage cross-sectional area of the restrictor 2*c*. Each of the collision parts 3 is configured as a thread member. As shown in FIG. 2, the four collision parts 3 are threaded into thread holes 3*h* formed at the component main body 6 from the outer peripheral surface side thereof toward the restrictor 2*c* in radial directions. The segment regions 2*e* are formed such that the flow channel cross-sectional areas are equal to each other.

The water (warm water) supplied to the shower is gas-dissolved liquid, in which the air is dissolved. In FIG. 2, the gas-dissolved liquid flow supplied to the inflow end of the component main body 6 collides with the collision parts 3. Then, the gas-dissolved liquid flow is distributed to the respective segment regions 2*e* and passes through the segment regions 2*e* at increased speed. The pressure reduction effect causes the gas dissolved in the gas-dissolved liquid to deposit as bubbles, turning the gas-dissolved liquid into bubble-containing liquid. The bubble-containing liquid is sprayed through the head part 100H of FIG. 1 as a shower water flow.

As shown in FIG. 3, high-speed flow gaps 2*g*, 2*k* are formed between the tip end portions of two or more of the multiple collision parts 3 that project toward the cross-sectional center of the restrictor 2*c*. The high-speed flow gaps 2*g*, 2*k* allow a cross-sectional central flow to pass therethrough at a flow rate higher than that of a cross-sectional peripheral flow. The collision part 3 has a conical portion 5*t* formed at a tip end portion thereof. The conical portion 5*t* has a cross-section reduced toward its tip end. In the present embodiment, the conical portion 5*t* is shaped in a conical shape but may have another pyramid shape such as a square pyramid or a hexagonal pyramid. A slit part 2*g* is formed between the corresponding outer peripheral surfaces of the conical portions 5*t* of the two collision parts 3 adjacent to each other across the segment region 2*e* and constitutes the high-speed flow gap. A central gap 2*k* is formed between tips of the four collision parts 3 that are opposed to each other in the inner diameter directions across the cross-sectional center of the restrictor 2*c*. The central gap 2*k* constitutes the high-speed flow gap.

As shown in FIG. 3, the collision parts 3 are provided such that the projecting directions of the collision parts 3 intersect with each other orthogonally to form a cross shape on the transverse cross-section of the restrictor 2*c*. The collision parts 3 divide the restrictor into four restriction segment regions 2*e*. The four collision parts 3 project toward the central part of the flow channel 2 from the inner peripheral surface of the flow channel 2. The four slit parts 2*g* are formed between the outer peripheral surfaces of the conical portions 5*t* of the collision parts 3 adjacent to each other across the respective segment regions 2*e*. The central gap 2*k* is formed between the tip ends of the collision parts 3 opposed in the inner diameter direction. As a result, the high-speed flow gap is formed in the cross shape with the four slit parts 2*g* integrated via the central gap 2*k*.

As shown in FIG. 3, the outer peripheral surface of each of the collision parts 3 has restriction ribs 5*r* turning in a circumferential direction of the outer peripheral surface multiple times and arranged along a projecting direction of the collision part 3. A root portion 21 has a shape with a width reduced toward the bottom of the root. The multiple restriction ribs 5*r* have crests that have acute angles and are adjacent to each other. An apex angle of the restriction rib 5*r* is set in a range from 20 degrees to 60 degrees, for example. As above, the collision part 3 is a threaded member, and the restriction ribs 5*r* turning multiple times are integrally formed as a helix.

Action and effects of the showerhead 100 of FIG. 1 will be described below. A shower hose (not shown) is connected to the hose connection part 103 of the showerhead 100, and a water flow is supplied through the shower hose. The water flow coming through the hose connection part 103 passes through the bubble generating engine 1 within the grip part 101 and is supplied to the shower main body 100M through the restrictor 101*b*. Then, the water flow is sprayed as the shower water flow through the water flow spraying part 102 having the spraying plate 109.

As shown in FIG. 2, in the bubble generating engine 1, the cross-sectional area of the flow channel 2 is not reduced at the restrictor 2*c* in a radial direction in a homothetic manner toward a cross-sectional center O, where the flow rate is high. Rather, by using the collision parts 3 as obstacles, the cross-section of the flow channel is reduced by partly removing a region, where the liquid could pass, along a circumferential direction around the cross-sectional center. As a result, a fluid resistance at the restrictor 2*c* does not increase excessively, and thereby the effect of increasing the flow rate and the effect of generating a negative pressure are greatly enhanced. The cavitation effect (pressure reduction effect) for the gas-dissolved liquid distributed to the segment regions 2*e* (and the downstream regions thereof) is largely enhanced and leads to a larger amount of deposited bubbles even for the water flow with the same dissolved air concentration. The restrictor 2*c* as a part having a constant cross-section is formed between an inflow-side tapered part 2*a* and an outflow-side tapered part 2*b*. Since the collision parts 3 are provided to the constant cross-section part 2*c*, the flow having speed increased by the inflow-side tapered part 2*a* is stabilized by the constant cross-section part 2*c* and is lead to the collision parts 3. Therefore, it is possible to generate bubbles stably.

In the restrictor 2*c*, the flow around the cross-sectional center, at which the flow rate is maximized, bypasses the tip end portions of the collision parts 3 and is distributed to the respective segment regions 2*e*. As shown in FIG. 3, since the high-speed flow gaps 2*g*, 2*k* are formed between the tip end portions of the collision parts 3, the flow can pass through the cross-sectional center while the high flow rate around the cross-sectional center is not substantially reduced in the high-speed flow gaps 2*g*, 2*k*. As a result, the cavitation effect caused by the water flow passing through the gaps 2*g*, 2*k* is significantly increased at the high-speed flow gaps 2*g*, 2*k*, and thereby the size of the generated bubbles becomes remarkably small.

The slit parts 2*g* of the high-speed flow gaps 2*g*, 2*k* are formed between the corresponding end parts (conical portions) 5*t*, 5*t* of the collision parts 3 adjacent to each other across the respective segment regions 2*e*, and the slit parts 2*g* are formed in a direction of generatrix of the outer peripheral surface of the conical portion 5*t*. Thus, the flow toward the slit part 2*g* is restricted and compressed when the flow detours a swelling along the generatrix of the conical portion 5*t*. At that time, the movable space for the compressed liquid is secured in a longitudinal direction of the slit part 2*g*. Therefore, the flow rate is not likely to be reduced, and the cavitation effect (pressure reduction effect) is further enhanced. Also, the cavitation generation region is formed linearly along the slit part 2*g*. Therefore, a region where the bubbles deposit due to the pressure reduction is significantly enlarged, and thereby it is possible to deposit a large amount of fine bubbles.

The central gap 2*k* is formed to include the cross-sectional center and allows the central flow having the maximum flow rate to flow without the influence of the detour. Although the central flow is further restricted by passing through the central gap 2*k* and accelerated, the flow is allowed to detour toward the segment regions 2*e*, effectively limiting an increase in the fluid resistance. Due to the above, the cavitation effect (pressure reduction effect) at the cross-sectional center is enhanced further, and it is possible to deposit a larger amount of fine bubbles. Each flow distributed to each of the respective segment regions 2*e* generates a vortex flow or a turbulent flow at a position downstream of the collision part 3. Thereby, it is expected that the generated bubbles are caught in the vortex flow or the turbulent flow and the size of the bubbles becomes smaller advantageously.

Figure 4:
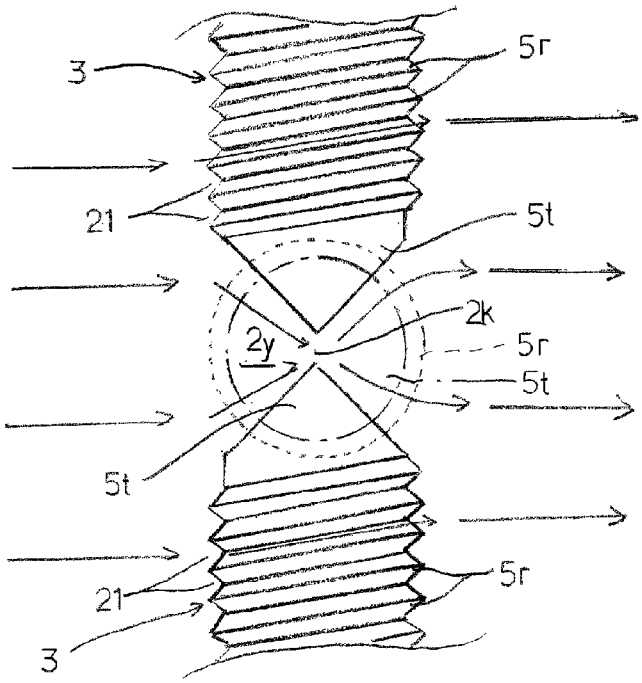
FIG. 4 is a diagram for explaining an action of collision parts.

As shown in FIG. 4, the high-speed flow near the cross-sectional center is effectively restricted by the four conical portions 5*t* provided to surround the cross-sectional center and flows into the central gap 2*k* at increased speed. As shown in FIG. 3, the central gap 2*k* is communicated with the four slit parts 2*g* positioned around the gap 2*k*. The flow restricted and compressed within the central gap 2*k* detours to the slit parts 2*g*, whereby it is possible to effectively limit an increase in the fluid resistance. Also, because the flow detouring toward the slit parts 2*g* has freedom in motion in a longitudinal direction of the slit, it is possible to limit the reduction in the flow rate. As a result, the cavitation effect (pressure reduction effect) is significantly activated both in the central gap 2*k* and the slit parts 2*g*, and it is possible to generate fine bubbles of nano-bubble levels at high concentrations. Also, because the tip ends of the collision parts 3 (the conical portions 5*t*) that face the central gap 2*k* are formed to be sharp, it is possible to further accelerate the flow near the collision parts 3 and thereby to further remarkably reduce the size of the bubbles.

The outer peripheral surface of the collision part 3 has the circumferential restriction ribs 5*r* turning thereon multiple times and arranged in the projecting direction of the collision part 3. The gas-dissolved liquid flowing in along the tangential direction of the outer peripheral surface of the collision part 3 is restricted within the groove parts 21 (or root portions) between the restriction ribs 5*r* and is further accelerated.

Figure 5:
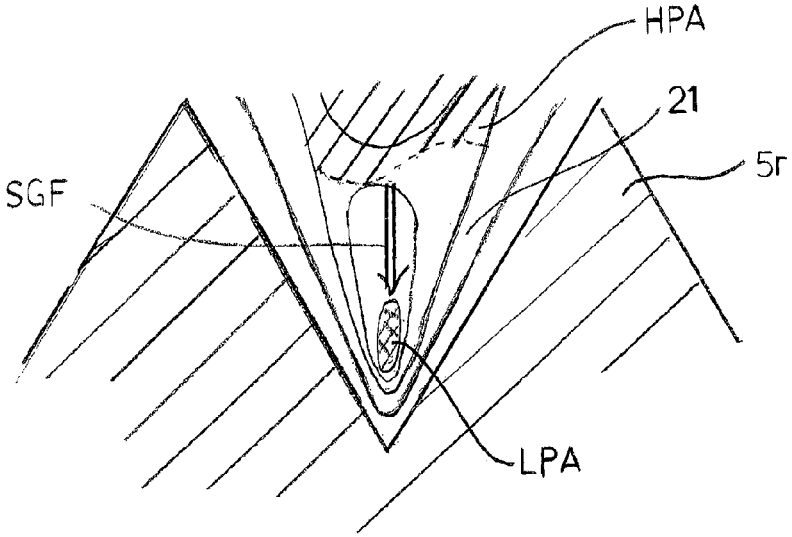
FIG. 5 is a diagram for explaining an action of restriction ribs.
Figure 6:
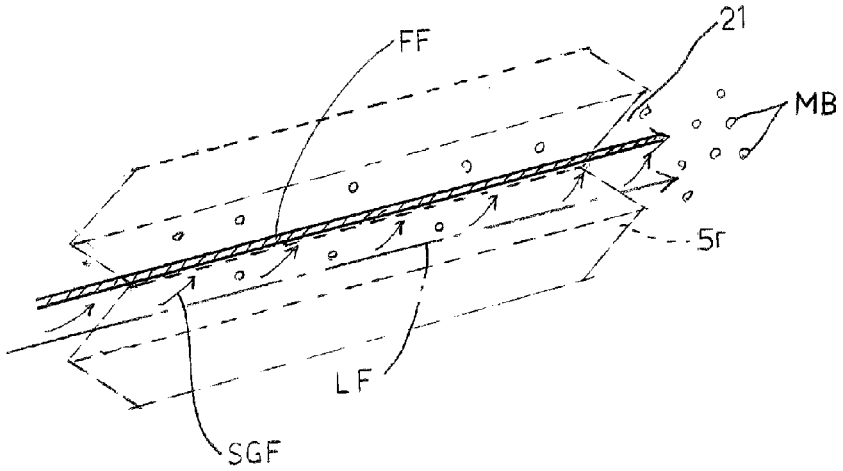
FIG. 6 is a diagram for explaining an action of the collision part.

Thus, the pressure reduction effect is enhanced. As shown in FIG. 5, a flow on a root opening side has a relatively reduced flow rate, and pressure on the root opening side becomes higher than the pressure of the high-speed flow on the root bottom side. In other words, a high-pressure area HPA of a low-speed flow is formed on the root opening side and a low-pressure area LPA of a high-speed flow is formed on the root bottom side. Gas saturation solubility of the liquid on the root opening side is increased and the gas saturation solubility on the root bottom side is decreased. As a result, as shown in FIG. 6, the air dissolved in the water flow (or gas dissolved liquid) SGF flows from a low-speed flow area LF on the root opening side (the high-pressure area HPA: FIG. 4) to a high-speed flow area FF (low-pressure area LPA: FIG. 5) on the root bottom side. Thus, the bubbles deposit quite actively.

As shown in FIG. 3, the collision part 3 is configured as a threaded member 5, and the restriction ribs 5*r* turning multiple times are formed integrally as a helix. The thread ridges can be used simply as the restriction ribs 5*r*. Since the restriction ribs 5*r* are inclined relative to the flow, more flow components intersect with the edge lines of the restriction ribs 5*r*. This significantly enhances the turbulent flow generation effect accompanying the flow separation, and thereby the size of the bubbles is further reduced advantageously.

As above, since the bubble generating engine 1 is assembled into the showerhead 100, the bubble generating engine 1 can easily form the shower water flow with the larger amount of bubbles even from the water flow having the same dissolved air concentration. Also, because the dissolved air forms bubbles due to the pressure reduction effect and deposition, a dissolved oxygen concentration in bulk water (or, a dissolved chlorine concentration in service water) is reduced, and thereby it is possible to effectively reduce the influence of the oxygen (or the chlorine) on skin and hair directly contacting the shower water flow. Specifically, as in FIG. 3, the restriction ribs 5*r* are continuously formed on the outer peripheral surfaces of all the collision parts 3. Therefore, the restriction ribs 5*r* (and the root portions) form a number of cavitation points for depositing the bubbles on the collision parts 3 contacting both sides of each of the segment regions 2*e*. This substantially activates the deposition of the bubbles, and the bubble concentration in the water flow is significantly increased. As a result, according to the showerhead 100, a large amount of bubbles can be introduced to an extent that a cloudy water flow can be formed only by using the deposition of the bubbles due to the cavitation even without taking in external air. Thus, rendition with a visual impact can be provided.

Figure 9:
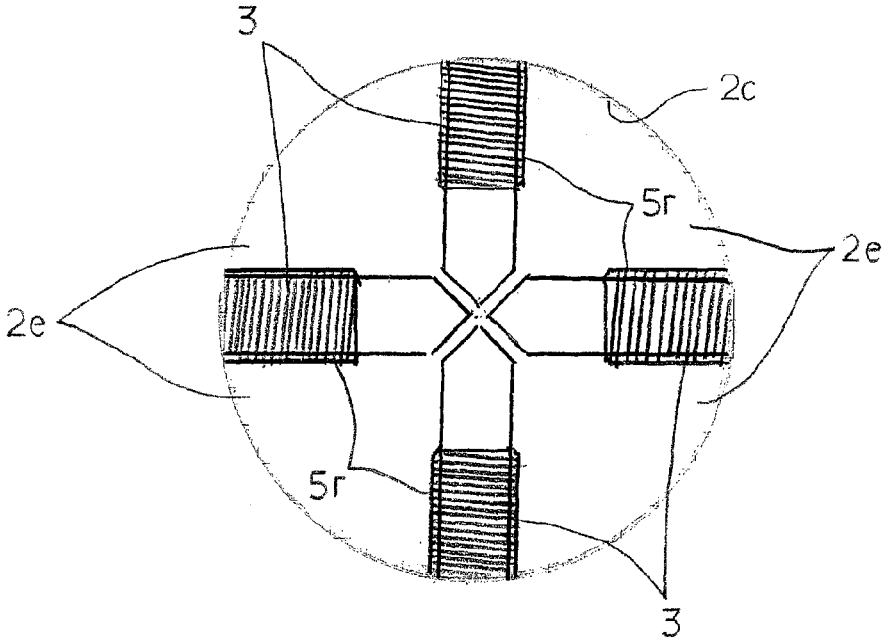
FIG. 9 is a diagram illustrating a third modification example of the collision parts.
Figure 10:
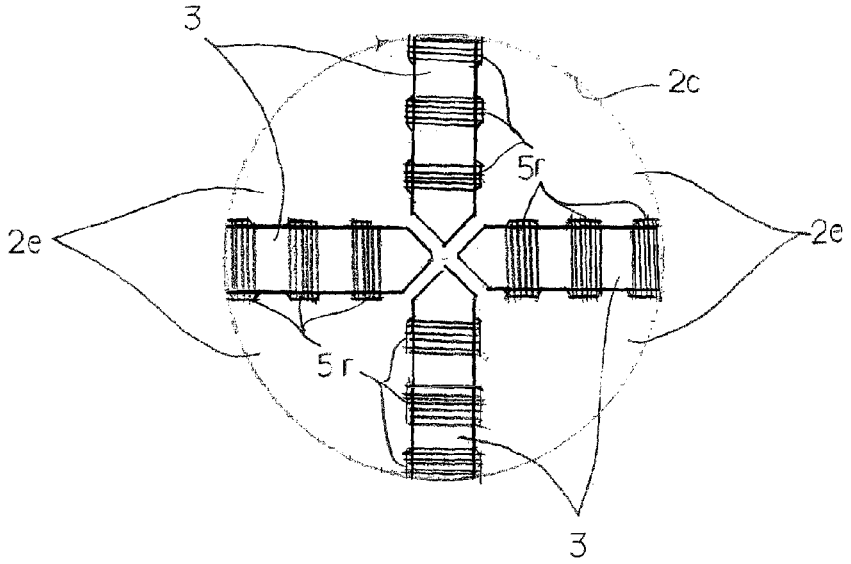
FIG. 10 is a diagram illustrating a fourth modification example of the collision parts.

Various modifications of the bubble generating engine of the present invention will be described below. As in FIG. 3, in a configuration, in which the restriction ribs 5*r* are continuously formed on the outer peripheral surfaces of all the collision parts 3, bubbles deposit excessively when the flow rate of the flow flowing into the restrictor 2*c* is large. In that case, there is a possibility that the deposited bubbles merge with each other to reduce the concentration of the fine bubbles. When the generation of fine bubbles is prioritized, it is effective to form the restriction ribs 5*r* on only a part of the outer peripheral surfaces of the collision parts as shown in FIGS. 8, 9 and 10 in order to control a deposition rate of the bubbles at the root portions.

Figure 8:
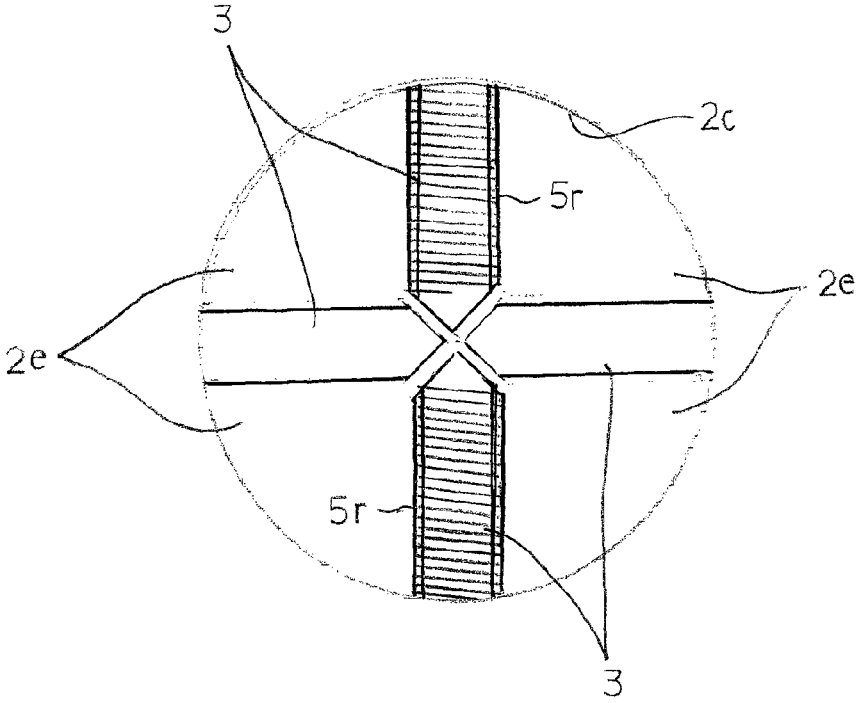
FIG. 8 is a diagram illustrating a second modification example of the collision parts.

FIG. 8 is a modification example, in which some of the multiple collision parts 3 have the restriction ribs 5*r* formed thereon and the rest of the collision parts 3 have no restriction ribs 5*r*. In this example, the collision part 3 with the restriction ribs 5*r* and the collision part 3 without the restriction ribs 5*r* are arranged alternately in a circumferential direction. Thus, one of the collision parts 3 contacting each of the segment regions 2*e* is configured to necessarily generate the cavitation effect due to the restriction ribs 5*r*.

Figure 7:
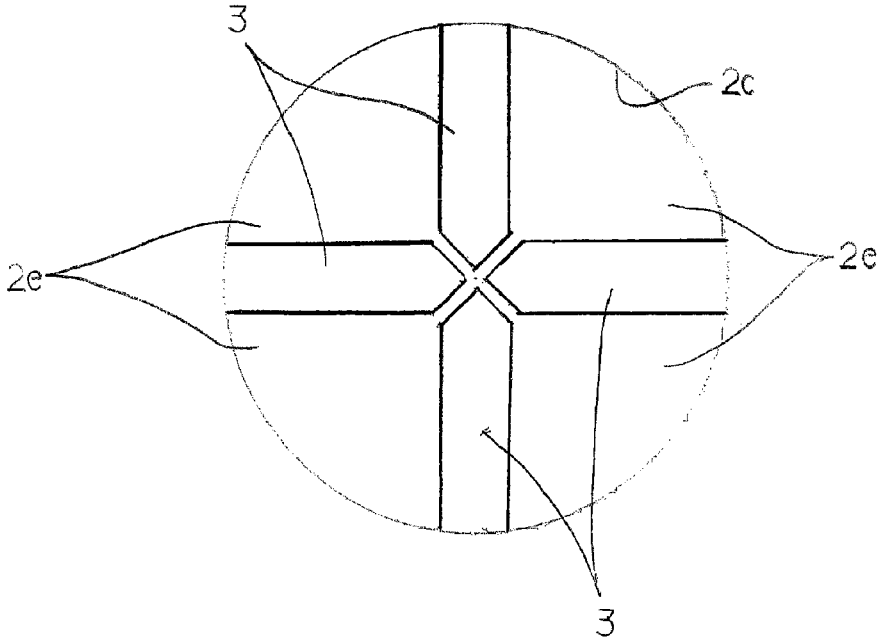
FIG. 7 is a diagram illustrating a first modification example of the collision parts.

Also, it is effective not to form the restriction ribs 5*r* on the tip end portions of the collision parts 3 positioned at the cross-sectional center where the high flow rate substantially contributes to generation of the fine bubbles but to form the restriction ribs 5*r* on the other regions in order to suppress the loss of the fine bubbles due to the merge of the bubbles. In FIG. 3, the outer peripheral surface of the conical portion 5*t* serving as the tip end portion of the collision part 3 has no restriction rib 5*r* formed thereon. If bubbles are formed excessively, the restriction ribs 5*r* may not be formed on the tip end side region of the cylindrical outer peripheral surface part that continues from the conical portion 5*t* as shown in FIG. 9. The above configuration generates a balanced combination of ultra-fine bubbles (specifically, nano bubbles from 10 nm to 800 nm) generated by the high-speed flow gaps 2*g*, 2*k* in the cross-sectional center region and fine bubble (micro bubbles from 1 μm to 100 μm) generated by the restriction ribs 5*r* in the outer peripheral region of the cross-section. Furthermore, FIG. 10 illustrates an example, in which the restriction ribs 5*r* are discontinuous in a longitudinal direction on the cylindrical outer peripheral surface part. When the generation of the nano bubbles is specifically prioritized, the restriction ribs on the outer peripheral surfaces of the collision parts may be removed as in FIG. 7.

Figure 11:
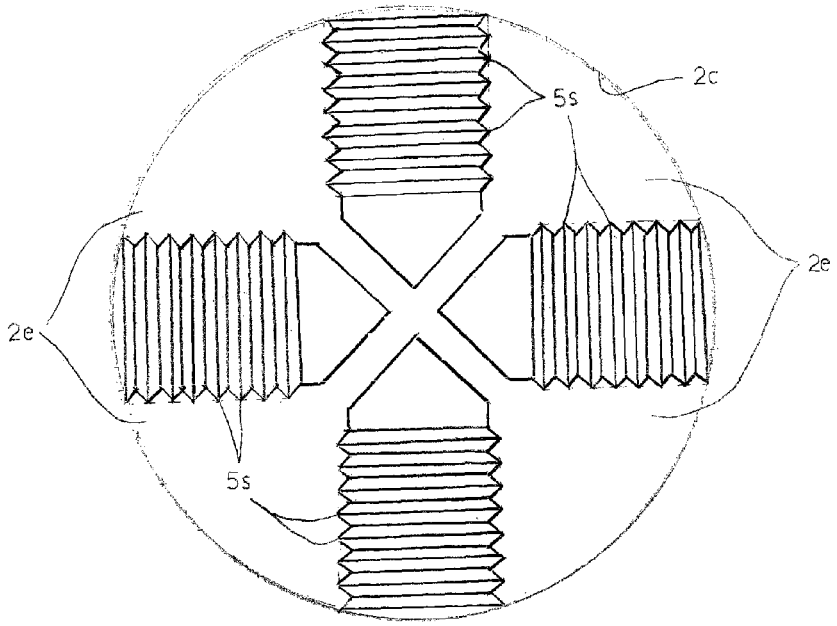
FIG. 11 is a diagram illustrating a fifth modification example of the collision parts.

As shown in FIG. 11, multiple independent restriction ribs 5*s*, each of which is closed circumferentially around the longitudinal axis of the collision part 3, may be formed densely on the collision part 3 and arranged in the longitudinal direction. In FIG. 11, each of the independent restriction ribs 5*s* is formed in a direction orthogonal to the longitudinal axis of the collision part 3. Alternatively, the restriction ribs 5*s* may be formed in another direction inclined to a plane orthogonal to the longitudinal axis. In the above configuration, as in the case of FIG. 3, the inclination of the restriction ribs causes the flow separation and enhances the resulting turbulent flow generation effect, and thereby the size of the bubbles can be reduced further.

Figure 12:
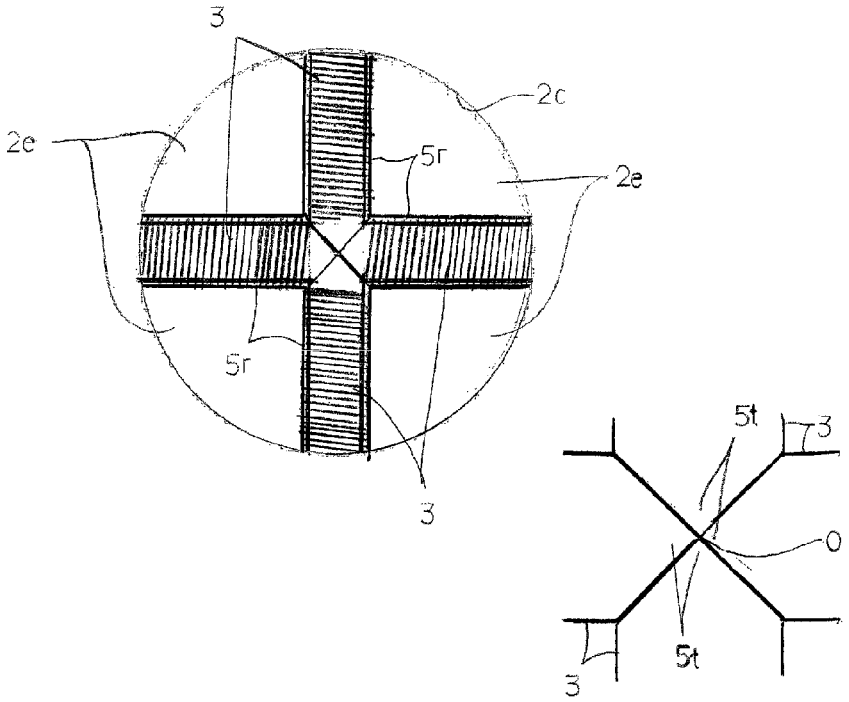
FIG. 12 is a diagram illustrating a sixth modification example of the collision parts.
Figure 13:
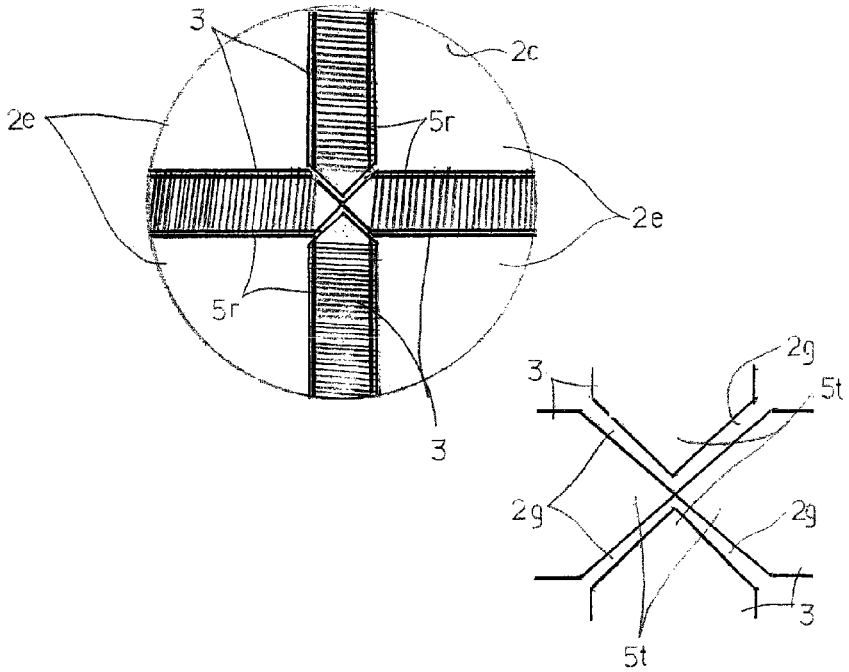
FIG. 13 is a diagram illustrating a seventh modification example of the collision parts.

In FIG. 3, the tip end angle of the conical portion 5*t* serving as the tip end portion of the collision part 3 is set at an angle of 90 degrees on a cross-section of the collision part 3 along a plane that includes the longitudinal axis of the collision part 3. In other words, the tip end angle of the conical portion 5*t* is obtained by dividing the entire perimeter angle of 360 degrees by the number "four" of the collision parts 3. As shown in FIG. 12, if the collision parts 3 are positioned such that the tip ends of the collision parts 3 are placed at the cross-sectional center of the restrictor 2*c* and the adjacent conical portions 5*t* closely contact each other at side surfaces thereof, the high-speed flow gaps are not formed. Due to the above, the flow of liquid is distributed to the segment regions 2*e* entirely, and the cavitation effect mainly caused by the restriction ribs 5*r* can generate bubbles. Also, as shown in FIG. 13, the tip ends of the conical portions 5*t* of a pair of the collision parts 3, 3 opposed to each other in the inner diameter direction may be in contact with each other, and the other pair of the collision parts 3, 3 may recede in the longitudinal directions thereof, whereby the slit parts 2*g* may be formed.

Figure 14:
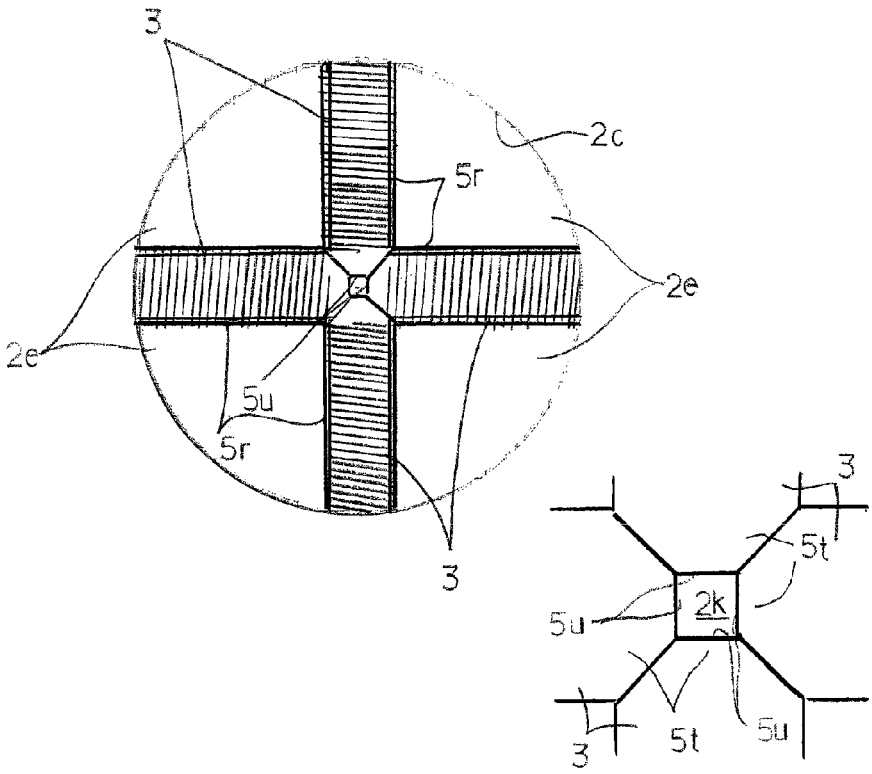
FIG. 14 is a diagram illustrating an eighth modification example of the collision parts.
Figure 15:
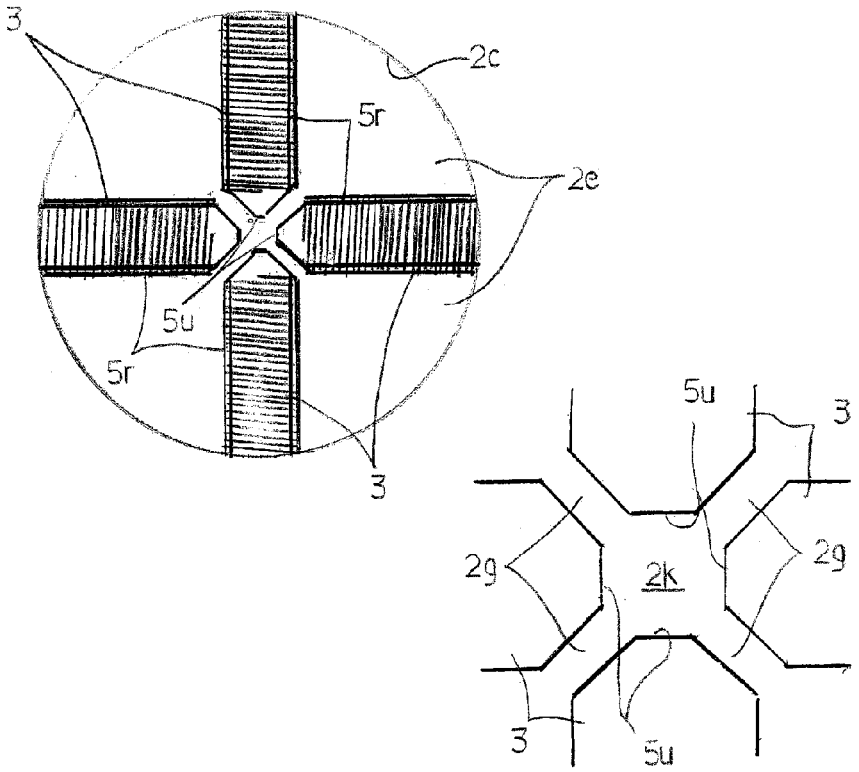
FIG. 15 is a diagram illustrating a ninth modification example of the collision parts.

The tip end of the collision part 3 may be flat. In examples shown in FIGS. 14 and 15, flat end surfaces 5*u* are formed by cutting the tip end portions of the conical portions 5*t* configured similarly to those in FIG. 3. Due to the above, it is possible to enlarge the central gap 2*k* and also to uniform the flow, and thereby this contributes to increase of the concentration of the generated fine bubbles as a whole. In FIG. 14, side surfaces of the adjacent conical portions 5*t* are in close contact with each other, and the central gap 2*k* is formed as a gap with closed periphery by forming the flat end surfaces 5*u*. FIG. 15 shows an example, in which the slit parts 2*g* are formed between the side surfaces of the adjacent conical portions 5*t*.

Figure 16:
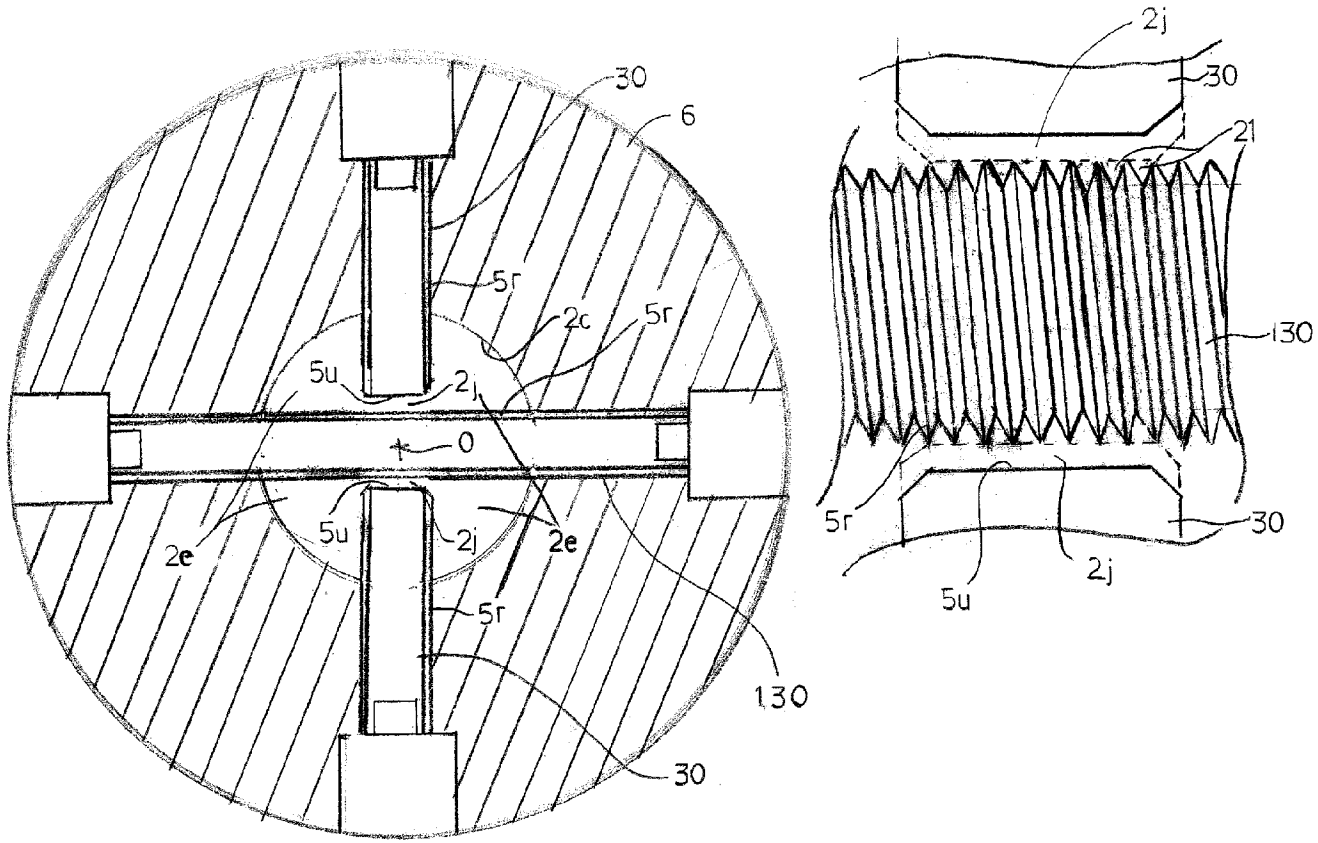
FIG. 16 is a diagram illustrating a tenth modification example of the collision parts.

In a configuration of FIG. 16, a main collision part 130 is placed to intersect with the cross-section of the restrictor 2*c* along an inner diameter, and furthermore, a pair of the opposed collision parts 30, which are opposed to each other across the cross-sectional center of the restrictor 2*c* in the inner diameter direction, are provided in a direction orthogonal to the main collision part 130. Peripheral gaps 2*j*, which constitute the high-speed flow gap, are formed between the end surfaces of the respective opposed collision parts 30 and an outer peripheral surface of the main collision part 130. When an inner diameter dimension of the restrictor 2*c* needs to be shortened, the above configuration can be made simpler than that of the configuration forming the central gap 2*k*. The flow near the cross-sectional center collides with the main collision part 130 and bypasses the main collision part 130. The flow is accelerated by the influence of a centrifugal force due to bypassing the main collision part 130 and passes through the peripheral gaps 2*j* formed by the opposed collision parts 30. Thus, it is advantageous that the influence caused by the decrease in the flow rate due to the collision with the main collision part 130 is not substantial.

In the configuration of FIG. 16, the tip end of the opposed collision part 30 is flat, and the peripheral gap 2*j* is formed in the shape of a slit. Since the cavitation region can be extended in a longitudinal direction of the slit, fine bubbles of higher concentrations can be generated. The main collision part 130 is an integral member extending in the inner diameter direction and having both end portions embedded in the component main body 6. The restriction ribs 5*r* are formed on entirety of an outer peripheral surface of a part of the main collision part 130 exposed to the restrictor 2*c*. In the peripheral gap 2*j*, the outer peripheral surface of the main collision part 130 facing the end surfaces of the opposed collision parts 30 has protrusions and recesses defined by the restriction ribs 5*r*. The length of the gap is narrowed at a position of the restriction rib 5*r* (crest) and thereby a high-speed flow region is generated. Length of the gap is enlarged at the root portion 21, and thereby a low-speed flow region is generated. As a result, a difference in pressure between the above adjacent two regions causes a dissolved gas flow directed from the low-speed flow region to the high-speed flow region. Furthermore, the flow of the dissolved gas generated within the root portion 21 shown in FIG. 5 or 6 is added. Therefore, it is expected that the deposition of bubbles is activated significantly, and bubbles of high concentrations are generated. Also, the gap between the outer peripheral surface of the main collision part 130 and the opposed collision part 30 is reduced from a liquid inflow side toward a position where the outer peripheral surface of the main collision part 130 faces the end surface of the opposed collision part 30, whereby a restriction effect increases the flow rate and enhances the bubble generating effect advantageously. Alternatively, as indicated by a dashed line in FIG. 16, the end surfaces of the opposed collision parts 30 may be brought into contact with the restriction ribs 5*r* of the outer peripheral surface of the main collision part 130. Also in this case, the space defined by the root portions 21 forms the peripheral gap 2*j*, and thereby active bubble deposition can be expected.

Figure 17:
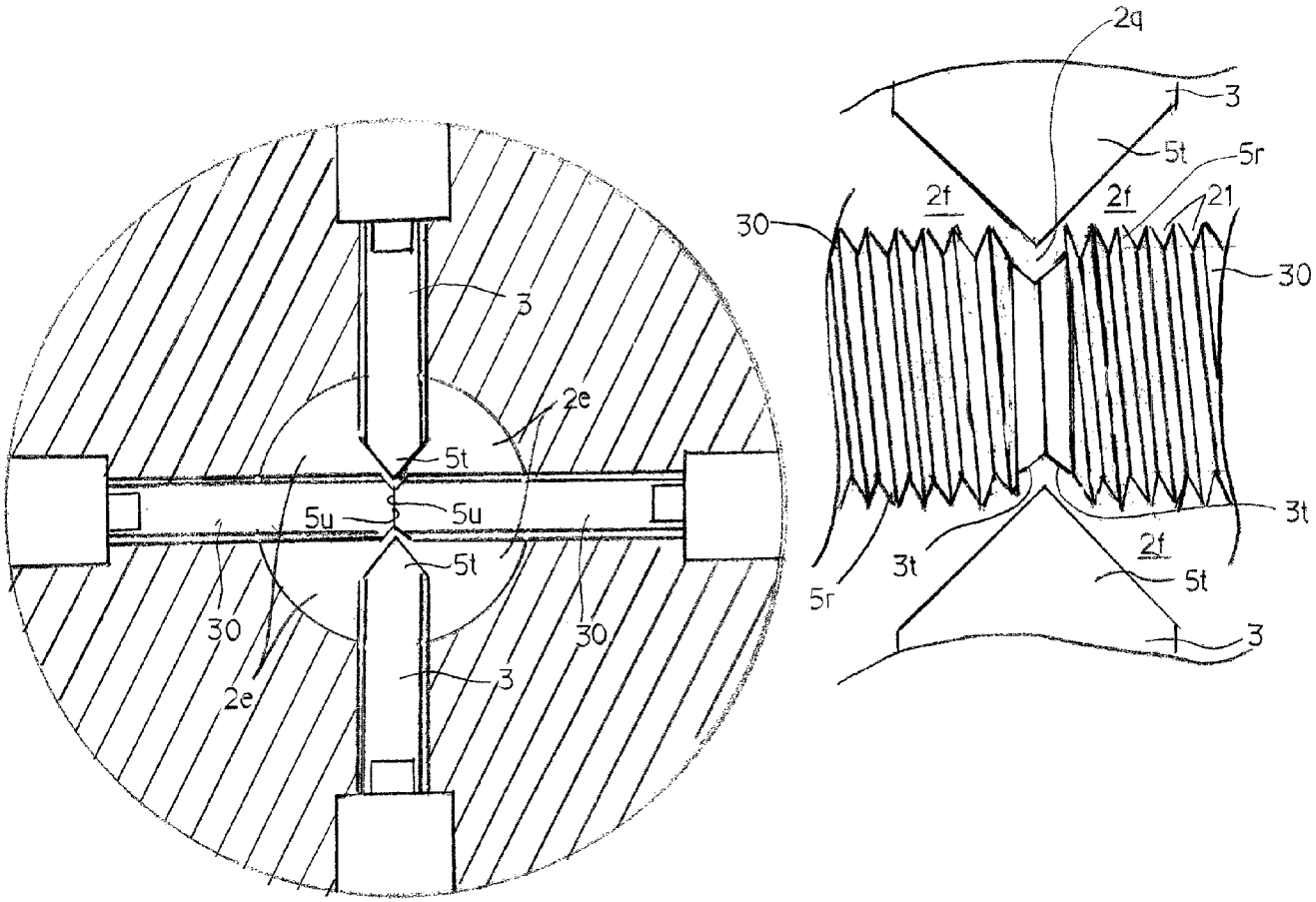
FIG. 17 is a diagram illustrating an eleventh modification example of the collision parts.

FIG. 17 is an example, in which tip ends of the opposed collision parts 3, 3 are sharpened. The restriction effect around the tip ends of the opposed collision parts 3 is enhanced in the peripheral gaps 2*q*, and thereby the size of the bubbles can be further reduced by using the increased flow rate. The main collision part includes a pair of collision parts 30, 30 each having a flat end surface 5*u* and a chamfered part 3*t* formed along the outer periphery of the end surface 5*u*. The collision parts 30, 30 are provided to be opposed to each other in the inner diameter direction of the restrictor 2*c* such that the collision parts 30, 30 contact each other at the end surfaces 5*u*, 5*u* thereof. The tip ends of the opposed collision parts 3, 3 form the peripheral gaps 2*q* by facing a groove part having a V-shaped cross-section formed by the chamfered parts 3*t* of the two collision parts 30, 30 that constitute the main collision part. Due to the above, the increase in the flow rate of the flow around the tip ends of the above opposed collision parts 3 enhances the effect of further reducing the size of the bubbles.

Figure 18:
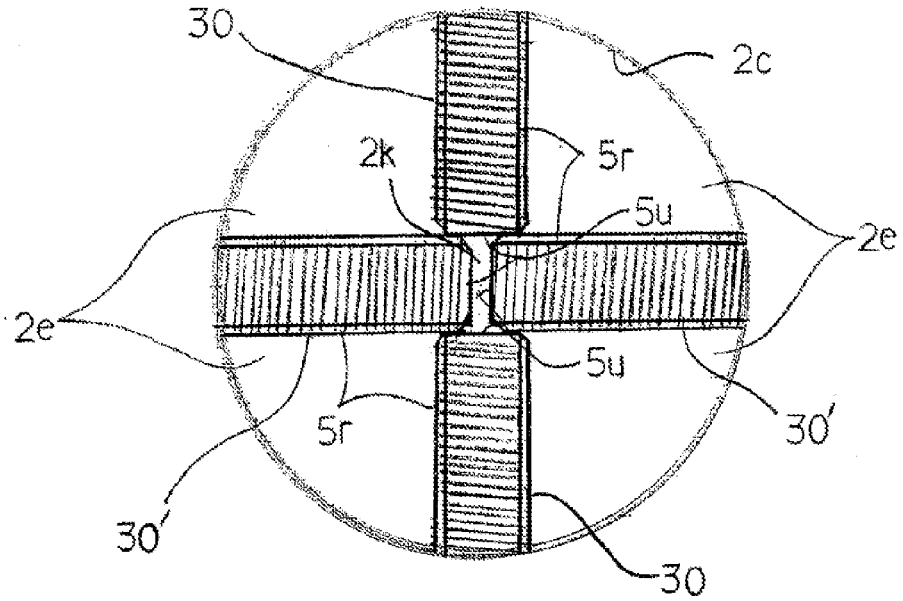
FIG. 18 is a diagram illustrating a twelfth modification example of the collision parts.
Figure 19:
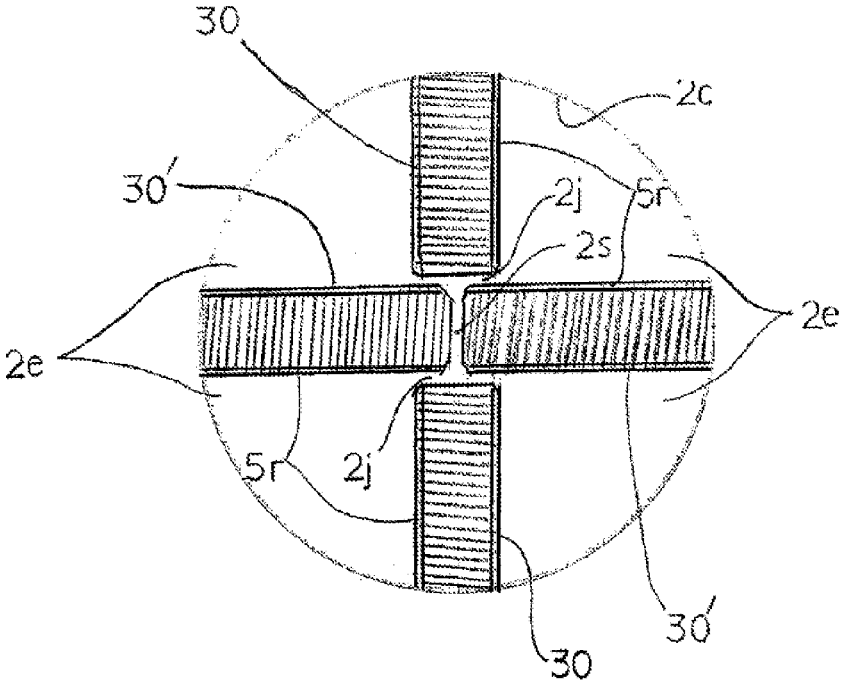
FIG. 19 is a diagram illustrating a thirteenth modification example of the collision parts.

As shown in FIGS. 18 and 19, the main collision part may be formed such that a pair of collision parts 30', 30' (hereinafter referred to as main collision parts 30', 30') having the flat end surfaces 5*u*, 5*u* are provided to face each other in the inner diameter direction of the restrictor 2*c* and such that the central gap 2*k* including the cross-sectional center of the restrictor 2*c* is formed between the end surfaces 5*u*, 5*u*. FIG. 18 illustrates a configuration, in which the respective end surfaces of the opposed collision parts 30, 30 are brought into contact with the outer peripheral surfaces of the tip end portions (and the restriction ribs 5*r*) of the main collision parts 30', 30'. By dividing the main collision part into the two collision parts 30', 30' as above and forming the central gap 2*k* between the end surfaces of the collision parts 30', 30', the flow near the cross-sectional center where the flow rate is maximized is further restricted by the central gap 2*k*, and thereby the speed of the flow is further increased. FIG. 19 illustrates an example, in which the end surface 5*u*,5*u* of the opposed collision parts 30, 30 are separated from the outer peripheral surfaces of the tip end portions (and the restriction ribs 5*r*) of the main collision parts 30', 30' to form the peripheral gaps 2*j* in a slit-like shape. The flow restricted and compressed within the central gap 2*s* detours to the peripheral gaps 2*j* in the slit-like shape and thereby an increase in the fluid resistance is limited quite effectively. Because the peripheral gap 2*j* is formed in the slit-like shape, a decrease in the flow rate after the detour is limited to a small amount. As a result, the cavitation effect (pressure reduction effect) is quite active both in the central gap 2*s* and the slit-like portions 2*j*, and thereby it is possible to generate fine bubbles of a nanobubble level at high concentrations.

Figure 20:
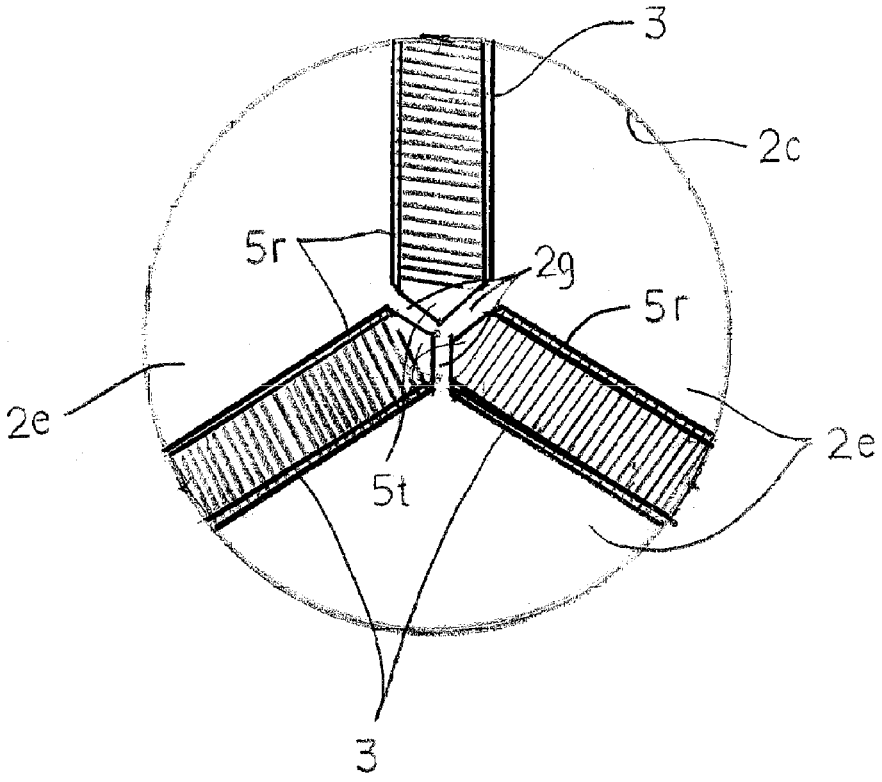
FIG. 20 is a diagram illustrating a fourteenth modification example of the collision parts.

In the above described embodiments, four segment regions are formed. However, the number of the formed segment regions is not limited to four, and for example as shown in FIG. 20, three collision parts 3 may alternatively form three segment regions 2*e*. Also, by reducing the outer diameter of the collision parts, five or more segment regions may be formed.

Figure 21:
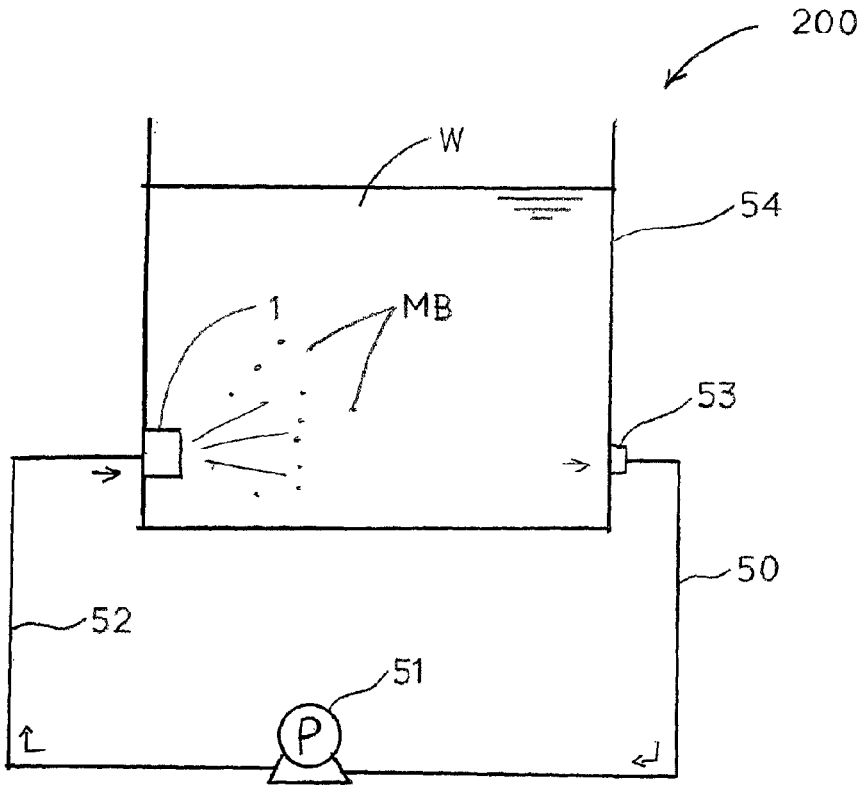
FIG. 21 is a schematic diagram illustrating another application of the bubble generating mechanism according to the present invention.

The bubble generating mechanism of the present invention is not limited to the shower but may be applied to various objectives. FIG. 21 is a schematic diagram of a circulation type bubble generating mechanism 200 using the bubble generating engine 1. The bubble generating engine 1 is assembled into a wall part of a water tank 54 and serves as a water flow ejection port of the water tank 54. Also, the wall part has a water flow intake port 53 at another position thereof such that a pump 51 circulates water W in the water tank via pipes 50, 52 and the bubble generating engine 1. When the water flow pumped by the pump 51 passes the bubble generating engine 1, bubbles MB are formed, and the water flow becomes bubble-containing liquid and is discharged into the water tank 54. Alternatively, a known ejector nozzle may be provided on the pipe 50 or the pipe 52, and external air may be suctioned and taken in through the ejector nozzle. Then, the suctioned gas may be further broken into smaller particles when the gas passes through the bubble generating engine 1, and may be discharged into the water tank 54.

Embodiment Example

A bubble generating engine 1 is prepared with the following specific dimensions for the flow channel and the collision parts of FIG. 2.

(FIG. 3)

Inflow port 2*n* and outflow port 2*x*: inner diameter D1=16 mm

Inflow-side tapered part 2*a*: flow channel length L3=24 mm

Outflow-side tapered part 2*b*: flow channel length L1=16 mm

Restrictor 2*c*: inner diameter D2=8 mm, flow channel length L2=8 mm Collision part 3: thread outer diameter: M2, the tip end portion has a conical point with a tip end angle 90 degrees in a cross-section taken along a longitudinal axis Size of central gap 2*k* (length between conical points of opposed collision parts 3): three conditions of 0 mm, 0.18 mm, and 0.36 mm A hose is connected to the bubble generating engine 2, and the inflow port 2*n* is supplied with water of 10 degrees C. at supply pressure of 0.12 MPa. Then, sprayed water is discharged into a water tank with the volume of approximately 90 liters. At this time, a spraying flow amount from the outflow port 2*x* is approximately 10 liters/minute.

Water accumulated in the tank is discharged through a measurement water discharge pipe (height of a discharge port from a tank bottom surface is approximately 40 cm) provided at a side wall of the water tank and is guided to a measurement cell of a laser diffraction particle size distribution analyzer (SHIMADZU CORPORATION: SALD-7100H) for measuring bubble diameter distribution. The laser diffraction particle size distribution analyzer emits laser light beam to the measurement cell at a constant angle. Scattering light intensity for each angle is sensed with individual one of separate light sensors based on the fact that a scattering angle differs according to the particle diameter of the measurement target particle (bubble in the present specification). Thus, information about the distribution of the particle diameter is obtained based on the intensity sensed with the sensors. As is obvious from the above measurement principle, in the laser diffraction particle size distribution analyzer, there is a tendency that as the volume of the bubble increases, the intensity of the scattering light sensed with the corresponding sensor increases. Therefore, the result computed directly based on an output intensity ratio of the multiple light sensors assigned with different target particle diameter ranges is distribution information using an index of a relative total volume of each particle diameter range (hereinafter, also referred to as volume relative frequency). A generally known average diameter is a number average diameter that is computed by dividing a total value of diameters of the particles by the number of the particles. However, in the case of the laser diffraction particle size distribution analyzer, because of the measurement principle, only a volume average diameter weighted by a particle volume can be calculated directly. Therefore, using standard software mounted on the device, the volume relative frequency was converted into the number relative frequency by assuming that the bubble has a spherical shape, whereby the bubble diameter distribution was calculated.

Figure 22:
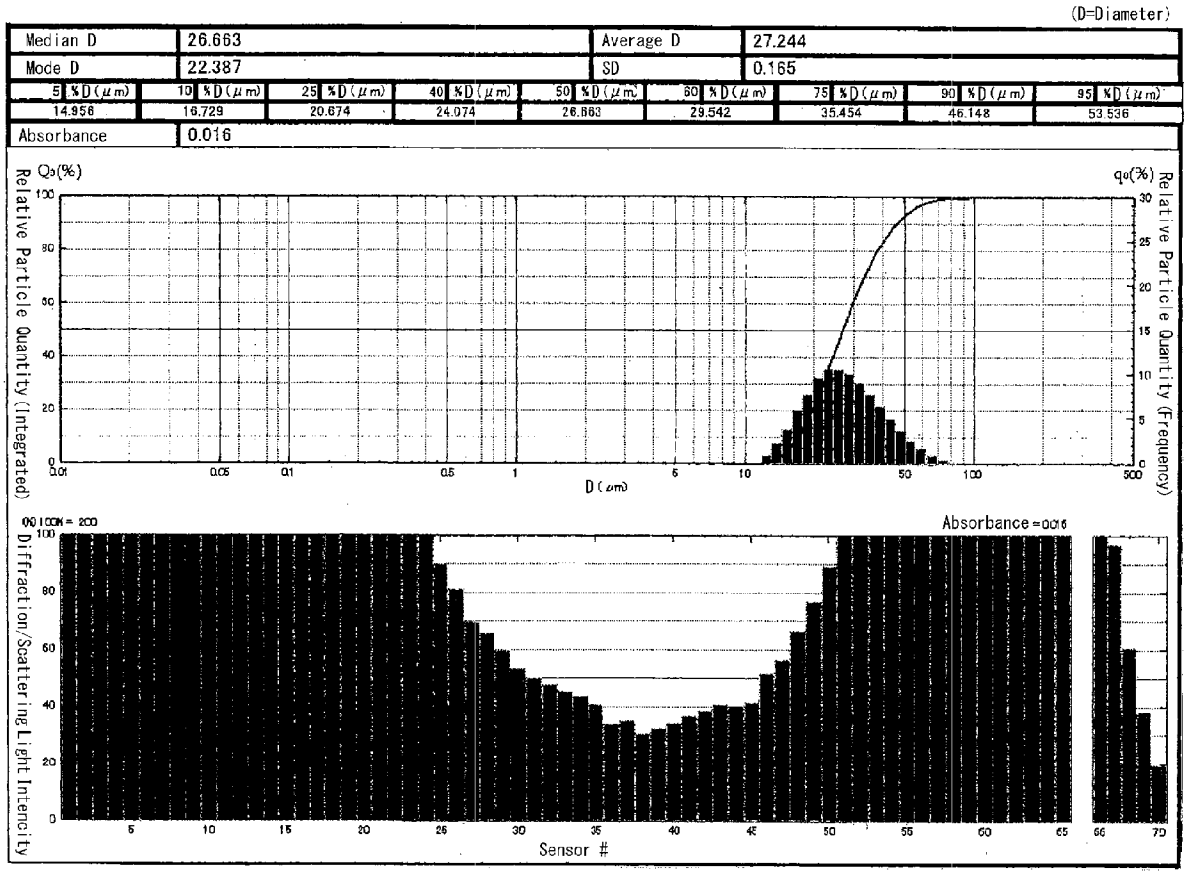
FIG. 22 is a first diagram illustrating bubble measurement results of an embodiment example.
Figure 23:
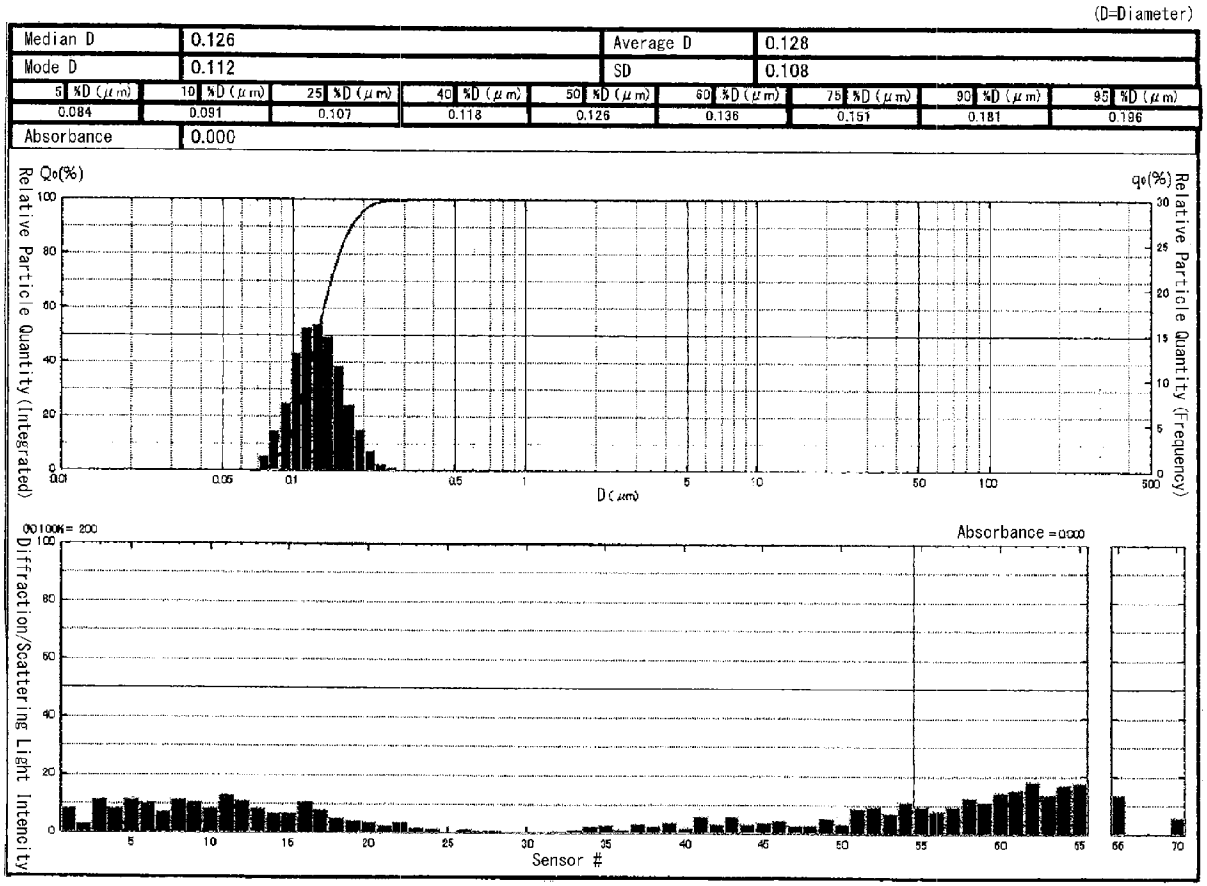
FIG. 23 is a second diagram illustrating the same as above.

FIG. 22 illustrates measurement results in the case where the water is continuously supplied, the supply pressure is 0.12 MPa and the central gap 2*k* is 0 mm (that is, the slit part 2*g* is not formed). In the drawing, the upper chart illustrates the bubble diameter distribution based on the number relative frequency, and the lower chart illustrates the scattering light intensity sensed with the respective sensors (in other words, at respective scattering angle positions) of the above case. When the water was supplied continuously, coarse bubbles, which were large enough to be visually recognizable, were generated significantly, and the water in the water tank became cloudy. The measurement result of the number average diameter is 27.244 μm. Then, the water supply was stopped, and the water in the tank was left standing for approximately one minute until the coarse bubbles rise to the water surface. Then the similar measurement was conducted. The results are shown in FIG. 23. The average diameter is 0.128 μm, and thereby it is found that very fine bubbles existed. However, absorbance of the water (a degree of loss of the laser light due to the scattering) has reduced significantly, and it is though that the concentration of the fine bubbles was low.

Figure 24:
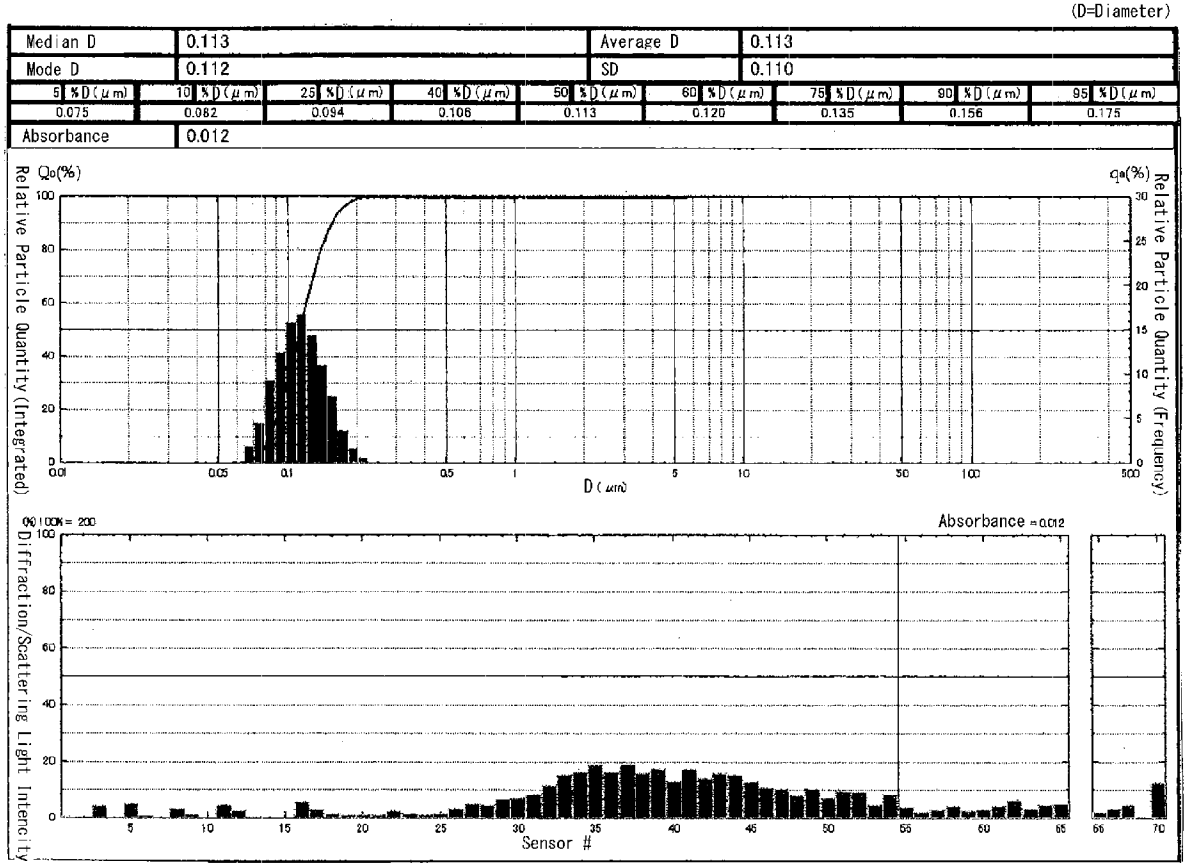
FIG. 24 is a third diagram illustrating the same as above.

FIG. 24 shows results of measurement conducted in the same way but under a condition that the supply pressure is reduced to 0.09 MPa. The water in the tank was left standing for approximately one minute after the water supply was stopped. Very fine bubbles of the average diameter 0.113 μm are observed, and the absorbance is 0.012, which is high. It is found that the fine bubbles were generated at a relatively high concentration. It is found that the high-concentration fine bubbles can be generated even with the engine having no central gap by setting the supply pressure to be relatively low to appropriately suppress the merge of the bubbles.

Figure 25:
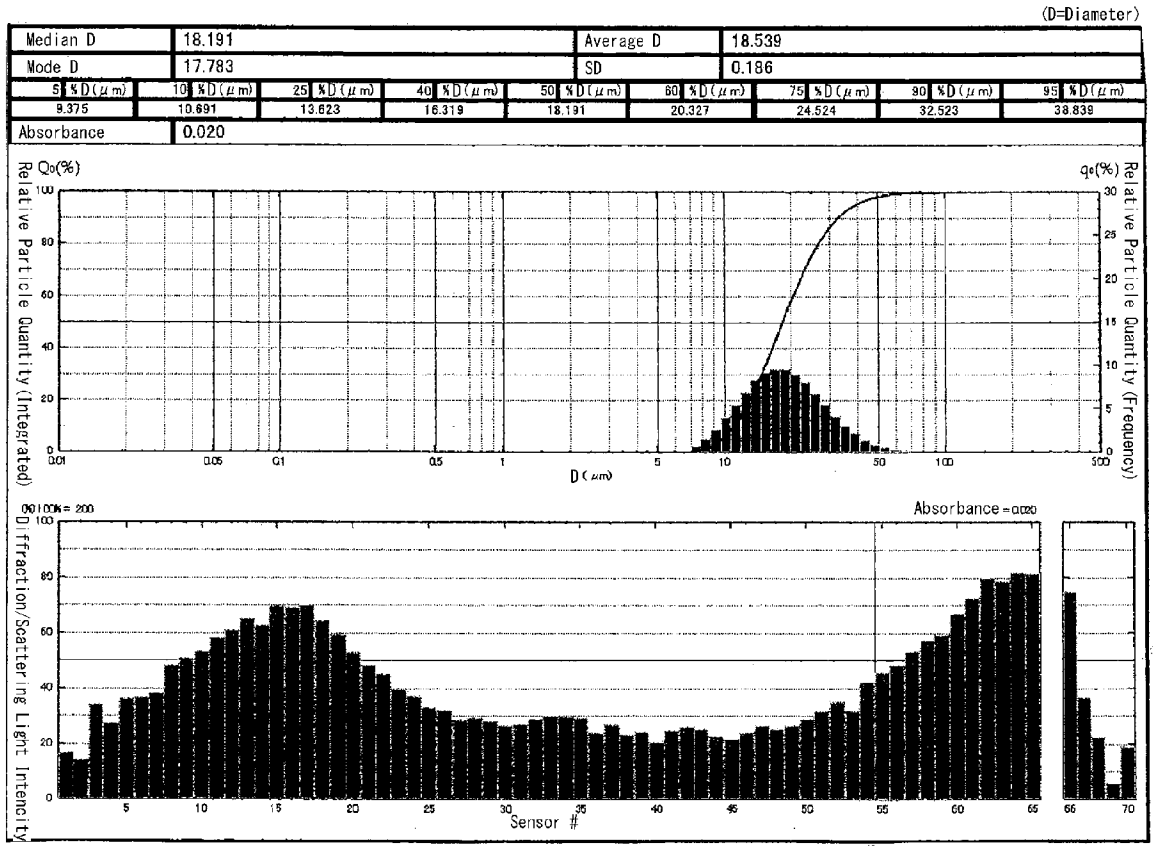
FIG. 25 is a fourth diagram illustrating the same as above.
Figure 26:
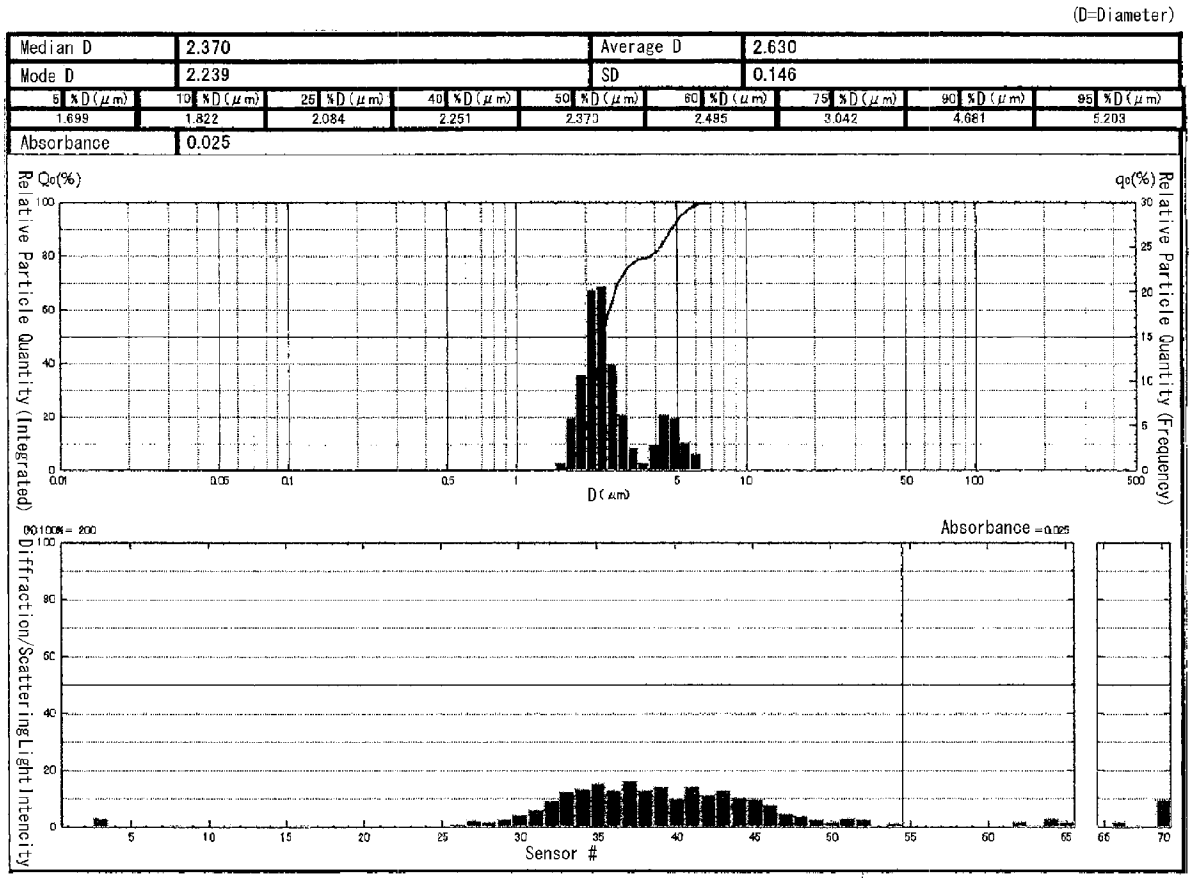
FIG. 26 is a fifth diagram illustrating the same as above.
Figure 27:
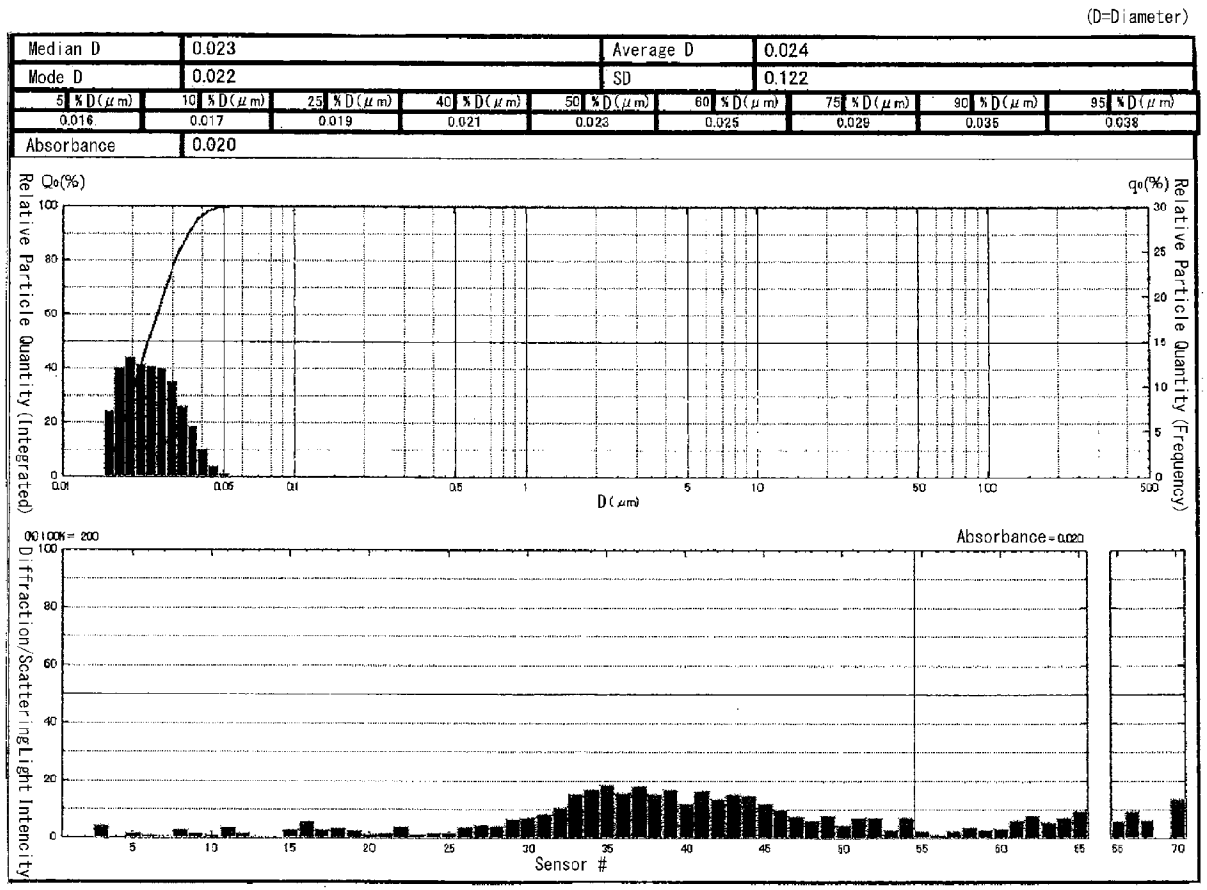
FIG. 27 is a sixth diagram illustrating the same as above.

FIG. 25 illustrates measurement results measured while water is continuously supplied under a condition that the supply pressure is 0.12 MPa and the central gap 2*k* is 0.18 mm. In this case, water in the water tank was also cloudy. However, rising speed of the bubble was obviously slower than in the case where the central gap 2*k* is not formed, and the average diameter of the bubbles has reduced to 18.539 μm. FIG. 26 shows the measurement results conducted one minute after the water supply was stopped. It is found that a relatively high absorbance (0.025) was maintained, and the average diameter reduced to 2.63 μm. Then, the supply pressure was reduced to 0.09 MPa and the water in the tank was left standing for about one minute after the water supply was stopped. At that time, the similar measurement was conducted. FIG. 27 illustrates the measurement results. The absorbance remains high at 0.020, and the average diameter is 0.024 μm. Thus, it is found that very fine bubbles were generated at high concentrations.

Figure 28:
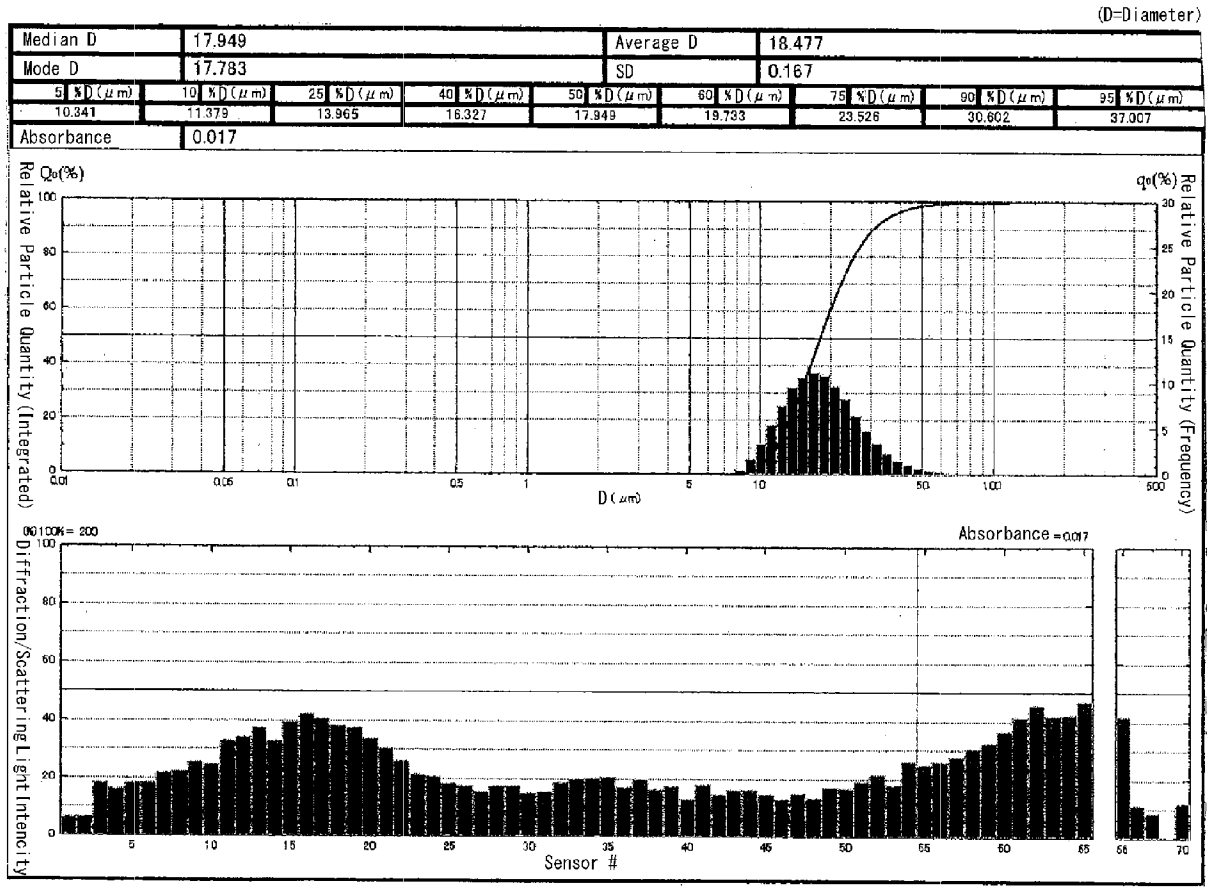
FIG. 28 is a seventh diagram illustrating the same as above.
Figure 29:
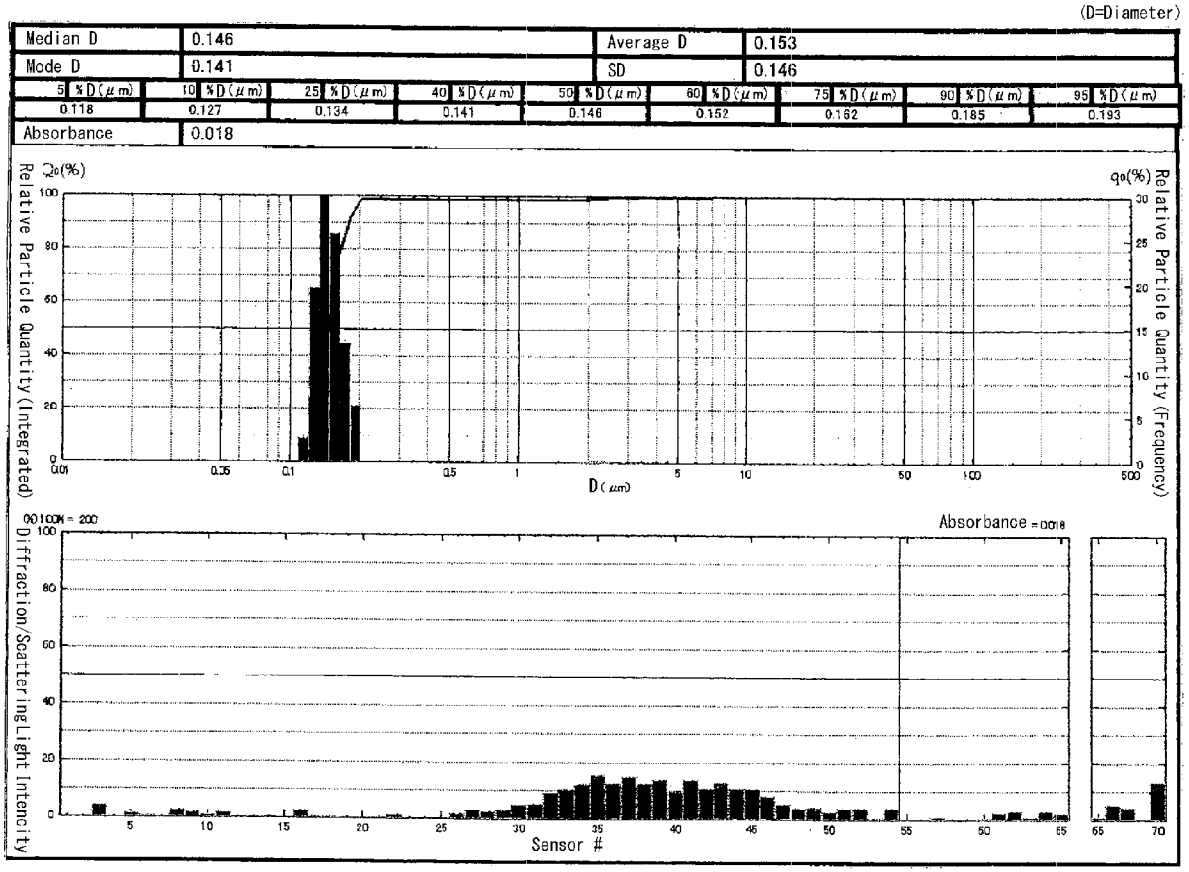
FIG. 29 is an eighth diagram illustrating the same as above.
Figure 30:
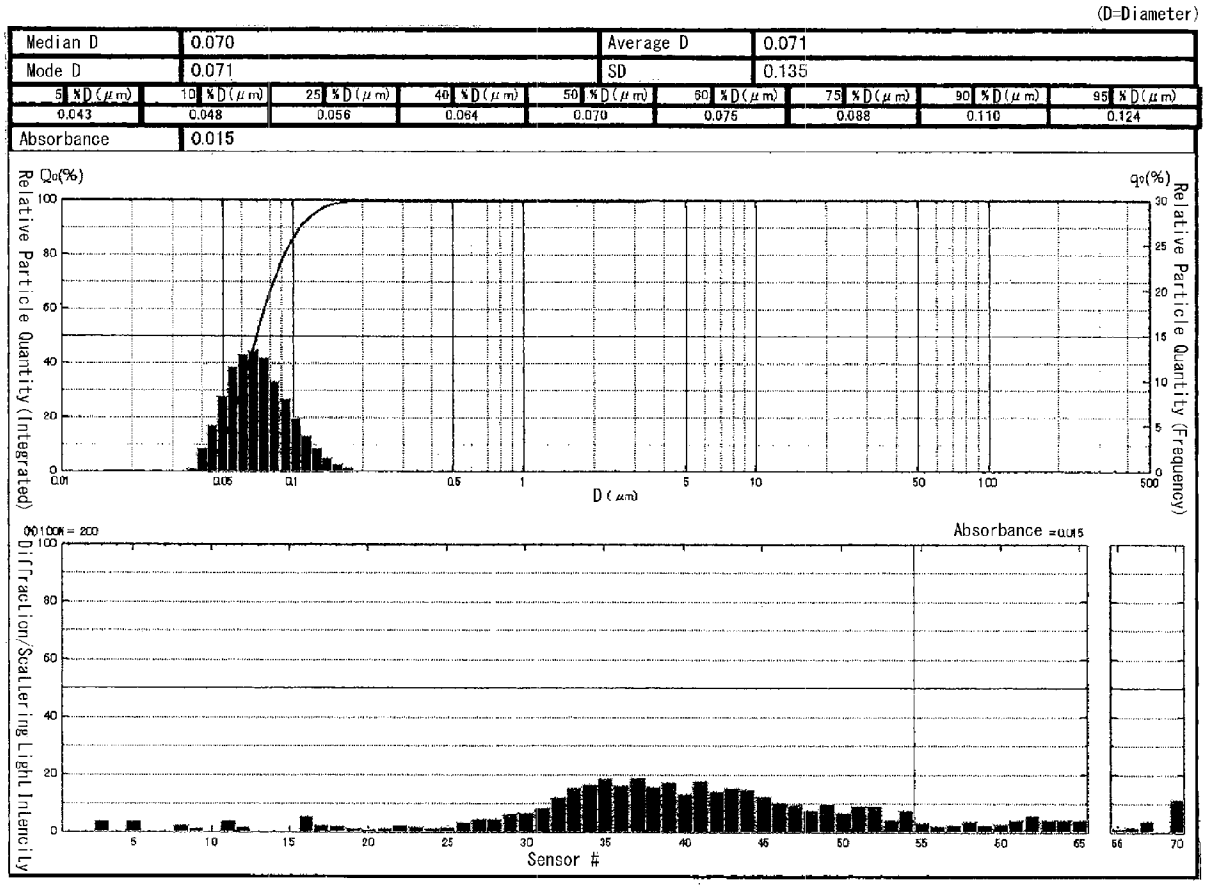
FIG. 30 is a ninth diagram illustrating the same as above.

FIG. 28 illustrates measurement results measured while the water is continuously supplied under a condition that the supply pressure is 0.12 MPa and the central gap 2*k* is set at 0.36 mm. The average diameter of the bubbles is 18.477 μm, which is smaller than in the case where the central gap 2*k* is not formed. FIG. 29 illustrates the measurement results conducted one minute after the water supply was stopped. The absorbance remained relatively high (0.017), and the average diameter reduced to 0.153 μm. It is found that even when the supply pressure is slightly high, fine bubbles in a nanometer range are generated at high concentrations. The supply pressure was reduced to 0.09 MPa, and the water in the tank was left standing for approximately one minute after the water supply was stopped. At that time, the similar measurement was conducted. FIG. 30 illustrates the measurement results. The absorbance remained high at 0.015, and the average diameter was 0.071 μm. Thus, it is found that the very fine bubbles were generated at high concentrations.

DESCRIPTION OF THE NUMERALS

1 Bubble generating engine (bubble generating mechanism)
2 Flow channel
2*a* Inflow-side tapered part
2*b* Outflow-side tapered part
2*c* Restrictor
2*e* Segment region
2*n* Inflow port
2*x* Outflow port
2*g* Slit part (high-speed flow gap)
2*k* Central gap (high-speed flow gap)
3, 30, 30', 130 Collision part
5*t* Conical portion
5*r* Restriction rib
6 Component main body
100 Shower

The invention claimed is:

1. A bubble generating mechanism comprising:

a component main body having an inflow end on a liquid inflow side and an outflow end on a liquid outflow side;

a flow channel formed in the component main body to extend therethrough, the flow channel connecting an inflow port opening in the inflow end with an outflow port opening in the outflow end;

a restrictor formed at a point within the flow channel, the restrictor having a passage cross-sectional area smaller than that of the inflow port; and collision parts provided at the restrictor to divide a transverse cross-section of the flow channel into three or more segment regions such that the collision parts further reduce the passage cross-sectional area of the restrictor, wherein:

after a flow of gas-dissolved liquid supplied to the inflow end of the component main body collides with the collision parts, the flow is distributed to each of the segment regions and then passes through the segment regions at an increased flow rate;

the gas-dissolved liquid is changed into bubble-containing liquid by depositing dissolved gas due to a resulting pressure reduction effect;

the bubble-containing liquid flows out of the outflow port;

a high-speed flow gap is formed between tip end portions of two or more of the collision parts projecting toward a cross-sectional center of the restrictor, the high-speed flow gap allowing a cross-sectional central flow to pass therethrough at a flow rate higher than that of a cross-sectional peripheral flow; and the collision parts include:

a main collision part provided to intersect with the cross-section of the restrictor along an inner diameter;

a pair of opposed collision parts provided to be opposed to each other in the inner diameter direction across a cross-sectional center of the restrictor such that the pair of opposed collision parts are provided in a direction orthogonal to the main collision part; and a peripheral gap that constitutes the high-speed flow gap and that is formed between an end surface of each of the opposed collision parts and an outer peripheral surface of the main collision part;

wherein a tip end of the opposed collision part is sharpened; and wherein the main collision part includes a pair of the collision parts, each of which has a flat end surface and a chamfered part formed along an outer periphery of each end surface, the pair of collision parts being provided to be opposed to each other in the inner diameter direction of the restrictor such that the end surfaces thereof are in contact with each other; and the tip ends of the opposed collision parts are opposed to a groove part having a V-shaped cross-section made by the chamfered parts of the two collision parts, which constitute the main collision part, whereby the peripheral gap is formed.

* * * * *